US010048626B2

(12) United States Patent
Shibuya et al.

(10) Patent No.: US 10,048,626 B2
(45) Date of Patent: Aug. 14, 2018

(54) FIXING DEVICE AND IMAGE FORMING APPARATUS

(71) Applicant: KONICA MINOLTA, INC., Chiyoda-ku, Tokyo (JP)

(72) Inventors: Takuto Shibuya, Toyokawa (JP); Naoki Yamamoto, Toyohashi (JP); Koji Takahashi, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/058,568

(22) Filed: Mar. 2, 2016

(65) Prior Publication Data

US 2016/0282777 A1 Sep. 29, 2016

(30) Foreign Application Priority Data

Mar. 25, 2015 (JP) ..... 2015-062069

(51) Int. Cl.
*G03G 15/20* (2006.01)

(52) U.S. Cl.
CPC ..... *G03G 15/2039* (2013.01); *G03G 15/2046* (2013.01); *G03G 2215/0132* (2013.01); *G03G 2215/2032* (2013.01)

(58) Field of Classification Search
CPC ..... G03G 2215/00755; G03G 2215/00759; G03G 2215/00029–2215/00059;
(Continued)

(56) References Cited

U.S. PATENT DOCUMENTS 5,311,268 A * 5/1994 Ohzeki ..... G03G 15/2003 219/216
2005/0277045 A1* 12/2005 Saito ..... G03G 9/0806 430/109.3

(Continued)

FOREIGN PATENT DOCUMENTS

JP 2002351251 A * 12/2002
JP 2006178027 A * 7/2006

(Continued)

OTHER PUBLICATIONS

Machine translation of Yoshioka (2006).*

*Primary Examiner* — Sevan A Aydin
(74) *Attorney, Agent, or Firm* — Buchanan Ingersoll & Rooney PC

(57) ABSTRACT

A fixing device includes a leading-end fixing value output part to output a leading-end fixing value indicating a leading-end fixing temperature and a leading-end separation value output part to output a leading-end separation value indicating a leading-end separation temperature. These output parts both output a higher value as a leading-end toner value representing a toner adhesion amount of a toner image in a leading area of a sheet is higher. A controller of the fixing device performs separation control to control a heating temperature by a heating source so that a leading-end set temperature at a fixing nip while the sheet leading area is passing through the fixing nip becomes equal to or higher than the leading-end fixing temperature. When the leading-end fixing value is lower than the leading-end separation value, the leading-end set temperature becomes equal to or higher than the leading-end separation temperature.

9 Claims, 10 Drawing Sheets

(58) Field of Classification Search
CPC ..... G03G 15/2039; G03G 15/2046; G03G 15/2078; G03G 2215/00738–2215/00742; G03G 2215/00751
See application file for complete search history.

(56) References Cited

U.S. PATENT DOCUMENTS

| | | | | |
|---|---|---|---|---|
| 2007/0212085 | A1* | 9/2007 | Mitsuya | G03G 15/2032 399/45 |
| 2013/0330097 | A1* | 12/2013 | Collison | G03G 15/2039 399/69 |
| 2014/0153950 | A1* | 6/2014 | Kan | G03G 15/2078 399/69 |
| 2015/0139676 | A1* | 5/2015 | Yamamoto | G03G 15/2039 399/69 |
| 2015/0168886 | A1* | 6/2015 | Tanaka | G03G 15/5025 399/69 |
| 2016/0116868 | A1* | 4/2016 | Yamamoto | G03G 15/2039 399/69 |

FOREIGN PATENT DOCUMENTS

| | | | | |
|---|---|---|---|---|
| JP | 2008-107658 | A | | 5/2008 |
| JP | 2014081473 | A | * | 5/2014 |

* cited by examiner

FIG. 4

| FIXING TEMP. TABLE [°C] | | TONER DENSITY | | |
|---|---|---|---|---|
| | | LOW | MIDDLE | HIGH |
| GRAMMAGE | LOW | 160 | 165 | 170 |
| | MIDDLE | 165 | 170 | 175 |
| | HIGH | 170 | 175 | 180 |

FIG. 5

| SEPARATION TEMP. TABLE [°C] | | TONER DENSITY | | |
|---|---|---|---|---|
| | | LOW | MIDDLE | HIGH |
| GRAMMAGE | LOW | 170 | 175 | 180 |
| | MIDDLE | 155 | 165 | 175 |
| | HIGH | 0 | 0 | 0 |

FIXING DEVICE AND IMAGE FORMING APPARATUS

CROSS-REFERENCE TO RELATED APPLICATIONS

This application is based upon and claims the benefit of priority from the prior Japanese Patent Application No. 2015-062069 filed on Mar. 25, 2015, the entire contents of which are incorporated herein by reference.

BACKGROUND OF THE INVENTION

1. Field of the Invention

The present invention relates to a fixing device and an image forming apparatus and, more particularly, to a fixing device for fixing a toner image on a sheet carrying thereon unfixed toner and an image forming apparatus including the fixing device.

2. Description of Related Art

Conventionally, an image forming apparatus, such as a copier, a printer, a facsimile machine, and a combined machine including their multiple functions, is configured to form an image on a sheet by fixing or fusing a toner image transferred to the sheet by use of a fixing device. The fixing device performs a fixing process to heat the sheet while the sheet is passing through a fixing nip provided between a pair of fixing members, thereby fixing the toner image on the sheet.

Herein, during the fixing process, a surface of the sheet that bears the toner image may be not smoothly separated from the fixing device even after the sheet passes through the fixing nip and may remain stuck to the fixing device, resulting in separation failure. This separation failure is likely to be caused when a large amount of toner is adhered to a leading end side of the sheet.

For example, Japanese unexamined patent application publication No. 2008-107658 discloses an image forming apparatus arranged to perform image formation in such a manner that a toner adhesion degree is compared between a leading end part and a rear end part of a toner image to be transferred onto a sheet and, when an amount of the toner to be transferred to a rear end side (bottom) of the sheet is smaller than that to a leading end side (top), the leading end part and the rear end part of the toner image are inverted. This can transfer either part of the toner image with a smaller toner adhesion amount onto the leading end side of the sheet, so that separation failure can be suppressed.

However, the conventional apparatus configured as above to suppress the failure to separate a sheet from the fixing device could cause an adverse result on an image formed on the sheet. Specifically, some images remaining inverted top to bottom may be output by the image forming apparatus. If the orientation of images is different from sheet to sheet output by the image forming apparatus, a user has to arrange the sheets so that their images are aligned in the same orientation. This is a troublesome task for the user.

The present invention has been made to solve the foregoing problems of the conventional techniques. Specifically, the present invention has objects of providing a fixing device and an image forming apparatus, in which a sheet having passed through a fixing nip can be appropriately separated from the fixing device without exerting any influence on an image to be formed.

SUMMARY OF THE INVENTION

To achieve at least one of the abovementioned objects, a fixing device reflecting one aspect of the present invention, configured to perform a fixing process for fixing a toner image on a sheet carrying unfixed toner when the sheet passes through a fixing nip of a pair of fixing members, comprises: a heating source for heating at least one of the pair of fixing members during the fixing process; a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end; a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher; a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control to control the heating temperature of the heating source so that the leading-end set temperature becomes equal to or higher than the leading-end separation temperature.

Further, another aspect of the present invention provides a fixing device configured to perform a fixing process for fixing a toner image on a sheet carrying unfixed toner when the sheet passes through a fixing nip of a pair of fixing members, the fixing device comprising: a heating source for heating at least one of the pair of fixing members during the fixing process; a press unit configured to press at least one of the pair of fixing members toward the other during the fixing process; a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end; a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher; a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a pressing force of the press unit and control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control by adjusting the pressing force of the press unit to be higher than that when the leading-end fixing value is higher than the leading-end separation value while the leading area of the sheet is passing through the fixing nip.

Still another aspect of the present invention provides a fixing device configured to perform a fixing process for fixing a toner image on a sheet carrying unfixed toner when the sheet passes through a fixing nip of a pair of fixing members, the fixing device comprising: a heating source for heating at least one of the pair of fixing members during the fixing process; a drive unit configured to drive the pair of fixing members to individually rotate in a normal direction during the fixing process; a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end; a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher; a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a speed of rotation of the pair of fixing members driven by the drive unit and control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control by adjusting the rotational speed of the pair of fixing members to be slower than that when the leading-end fixing value is higher than the leading-end separation value while the leading area of the sheet is passing through the fixing nip.

BRIEF DESCRIPTION OF THE DRAWINGS

FIG. 4 is a fixing temperature table;

FIG. 5 is a separation temperature table;

DESCRIPTION OF EMBODIMENTS

A detailed description of preferred embodiments of the present invention will now be given referring to the accompanying drawings. In the present embodiment, the invention is applied to an electrophotographic printer.

First Embodiment

Figure 1:
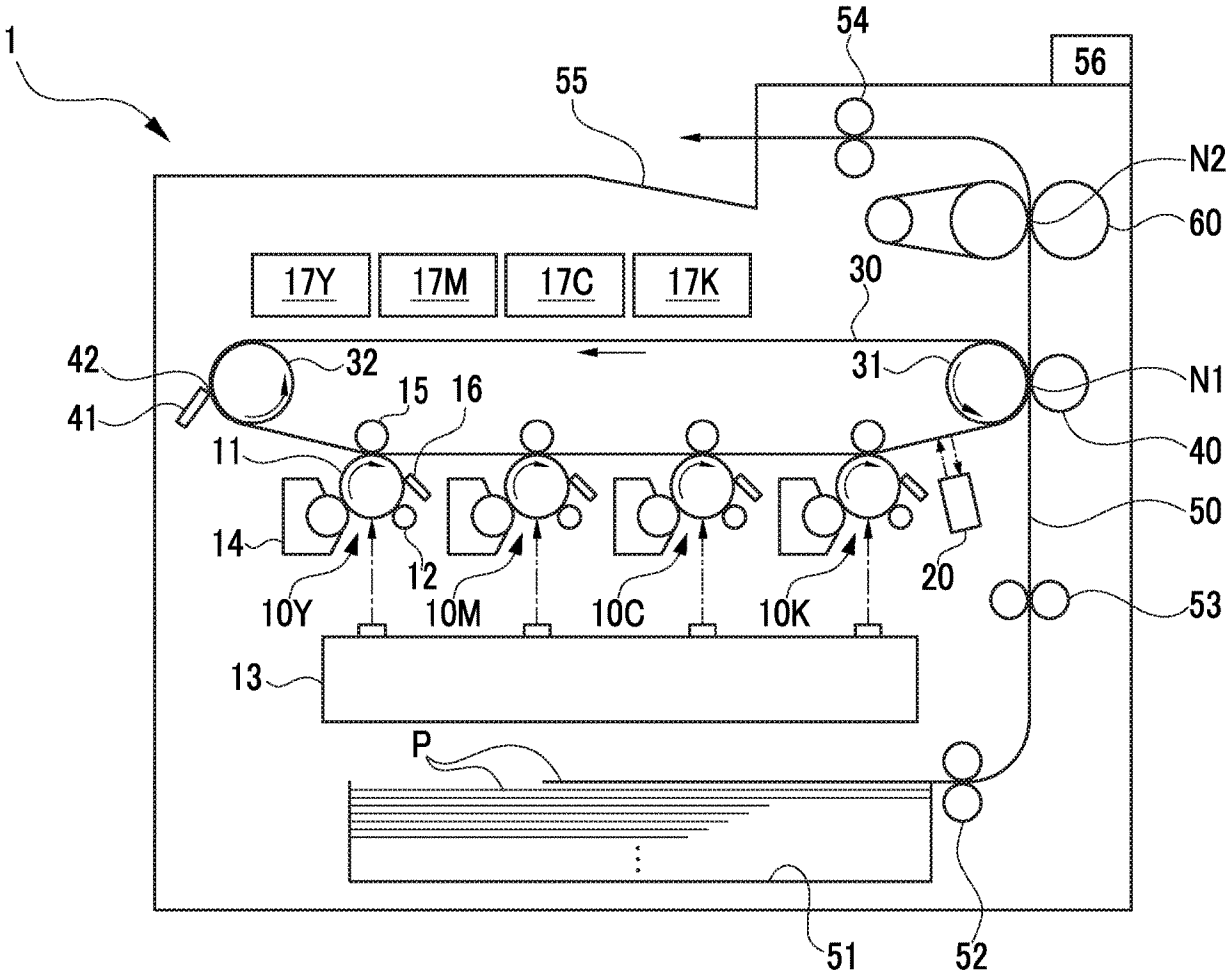
FIG. 1 is a schematic configuration diagram of an image forming apparatus in an embodiment.

FIG. 1 shows a schematic structure of an image forming apparatus 1 in the present embodiment. This image forming apparatus 1 is a so-called tandem color printer including an intermediate transfer belt 30. This intermediate transfer belt 30 is an endless belt member having electric conductivity. Both ends of the belt 30 in FIG. 1 are supported by rollers 31 and 32. During image forming, the roller 31 on a right side in FIG. 1 is driven to rotate counterclockwise. This causes the intermediate transfer belt 30 and the roller 32 on a left side in FIG. 1 to be rotated in each direction indicated by arrows in FIG. 1.

A secondary transfer roller 40 is provided in contact with an outer circumferential surface of a part of the intermediate transfer belt 30 supported by the roller 31 on the right side in FIG. 1. Specifically, the secondary transfer roller 40 is placed in pressure contact with the intermediate transfer belt 3 in a direction (leftward in FIG. 1) perpendicular to an axis of the roller 40. Contact portions of the intermediate transfer belt 30 and the secondary transfer roller 40 form therebetween a transfer nip N1 at which a toner image is transferred from the intermediate transfer belt 30 onto a sheet P. During image forming, the secondary transfer roller 40 is driven to rotate by a frictional force caused by pressure contact with the intermediate transfer belt 30 under rotation.

Further, a belt cleaner 41 is placed in contact with an outer circumferential surface of a part of the intermediate transfer belt 30 supported by the roller 32 on the left side in FIG. 1. Specifically, the belt cleaner 41 is placed in pressure contact with the outer circumferential surface of the intermediate transfer belt 30. Their contact portions form a collecting section 42 for collecting residual toner having been not transferred onto the sheet P at the transfer nip N1.

Image forming units 10Y, 10M, 10C, and 10K for respective colors; yellow (Y), magenta (M), cyan (C), and black (K), are arranged in order from left to right under the intermediate transfer belt 30 in FIG. 1. Each of the image forming units 10Y, 10M, 10C, and 10K is used to form a toner image of a relevant color and transfer it onto the intermediate transfer belt 30. The image forming units 10Y, 10M, 10C, and 10K are identical in structure and thus only the image forming unit 10Y is assigned reference signs in FIG. 1.

Each of the image forming units 10Y, 10M, 10C, and 10K includes a photoconductor 11 which is a cylindrical electrostatic latent image carrier, and a charger 12, a developing device 14, and a photoconductor cleaner 16, which are arranged circumferentially around the photoconductor 11. A primary transfer roller 15 is placed in a position opposed to the photoconductor 11 by interposing the intermediate transfer belt 30 therebetween. Further, an exposing device 13 is placed below the image forming units 10Y, 10M, 10C, and 10K for each color in FIG. 1. The charger 12 is arranged to uniformly charge a surface of the photoconductor 11. The exposing device 13 is arranged to irradiate a laser beam based on image data to the surface of the corresponding photoconductor 11 to form an electrostatic latent image thereon. The developing device 14 is arranged to apply toner stored therein to the surface of the photoconductor 11.

Each primary transfer roller 15 is pressed against the intermediate transfer belt 30 from a direction perpendicular to the axis of each roller 15 (a downward direction in FIG. 1). By this pressure contact, contact portions of the intermediate transfer belt 30 and each photoconductor 11 form a primary transfer nip for transferring a toner image from the photoconductors 11 for each color onto the intermediate transfer belt 30. The photoconductor cleaner 16 is arranged to collect the toner having been not transferred to the intermediate transfer belt 30 and remaining on the corresponding photoconductor 11.

In FIG. 1, the charger 12 is illustrated as a roller-shaped charging type, but the present invention is not limited to this. As another example, a corona charging charger, a blade-shaped charging element, or a brush-shaped charging element or the like may be used. Further, the photoconductor cleaner 16 is illustrated as a plate-shaped cleaner, which is placed with its one end portion resting on the outer circumferential surface of the photoconductor 11, but the present invention is not limited to this. As still another example, cleaning members such as a fixed brush, a rotating brush, a roller, may be used alone or in combination. In another example of using a cleaner-less type in which the residual toner on the photoconductor 11 is collected by the developing device 14, the photoconductor cleaner 16 may be omitted.

Further, above the intermediate transfer belt 30 in FIG. 1, hoppers 17Y, 17M, 17C, and 17K respectively storing toners of yellow, magenta, cyan, and black are provided. The toners stored in these hoppers are appropriately supplied to the corresponding-color developers 14.

At a position downstream of the image forming unit 10K and upstream of the transfer nip N1 in a rotating direction of the intermediate transfer belt 30, a density sensor 20 is provided to detect image density of a toner image transferred onto the intermediate transfer belt 30. The density sensor 20 is positioned to aim at a detecting point on the outer circumferential surface of the intermediate transfer belt 30. The density sensor 20 includes a light projecting part to irradiate light to a detecting point and a light receiving part to receive reflection light from the detecting point, which are used for example to adjust image density.

In a lower part of the image forming apparatus 1, a sheet feeding cassette 51 is detachably mounted. From a right side of the sheet feeding cassette 51, a sheet feed passage 50 is provided to extend upward in FIG. 1. Sheets P stacked in the sheet feeding cassette 51 are to be fed one by one from a topmost one to the sheet feed passage 50 by sheet feed rollers 52. Further, the image forming apparatus 1 in the present embodiment further includes a sheet type input unit 56. This sheet type input unit 56 is used by a user to input the type of a sheet(s) P stacked in the sheet feeding cassette 51.

On the sheet feed passage 50 into which a sheet P is fed by the sheet feed rollers 52, a pair of paper stop rollers (resist rollers) 53, the transfer nip N1, a fixing device 60, and ejecting rollers 54 are arranged in this order from an upstream side. On a further downstream side of the sheet feed passage 50, the image forming apparatus 1 is further provided on its top surface with a sheet output part 55. The resist rollers 53 are configured to adjust the timing of delivering the sheet P to the transfer nip N1. The fixing device 60 is configured to perform a fixing process to heat and press the sheet P at a fixing nip N2 to fix a toner image transferred onto the sheet P.

Figure 2:
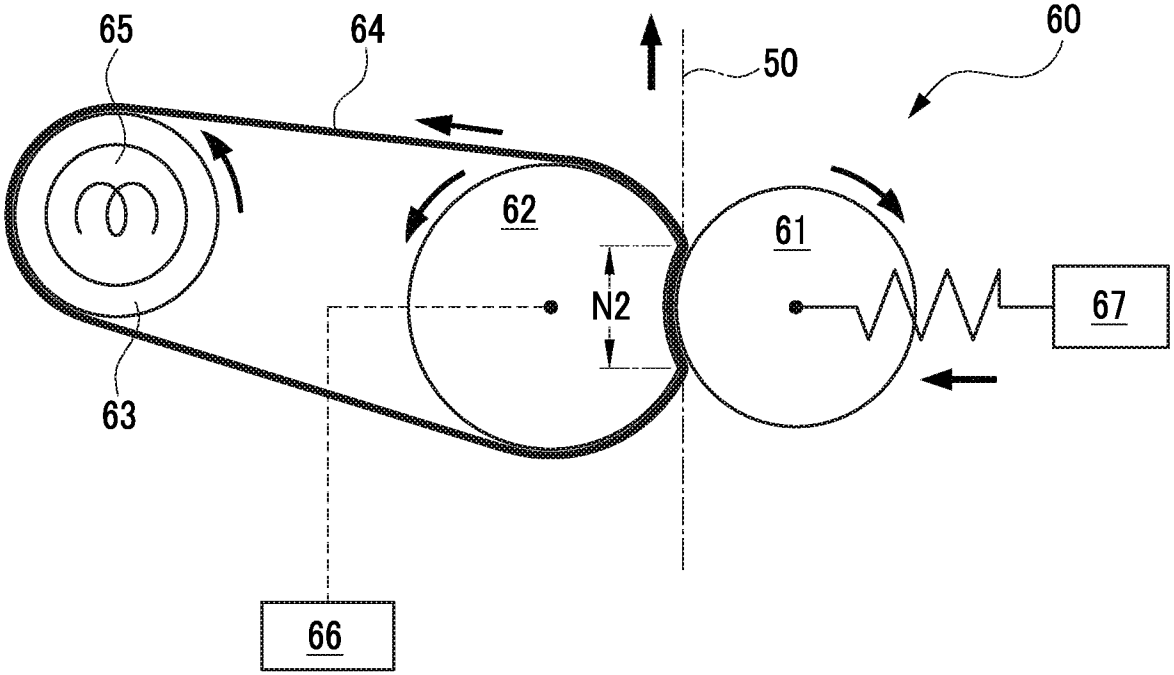
FIG. 2 is a diagram to explain a fixing device in the embodiment.

FIG. 2 shows the fixing device 60 in the present embodiment. This fixing device 60 includes, as shown in FIG. 2, a pressure roller 61, a fixing roller 62, a heating roller 63, and a fixing belt 64. These fixing roller 62, heating roller 63, and fixing belt 64 are arranged on a side facing the surface of a sheet P bearing a toner image.

As shown in FIG. 2, the fixing belt 64 is wound around the fixing roller 62 and the heating roller 63. The pressure roller 61 and the fixing roller 62 are arranged on opposite sides of the fixing belt 64 interposed therebetween. The pressure roller 61 is urged toward the fixing roller 62 by a press unit 67. Accordingly, the pressure roller 61 is pressed against on the outer circumferential surface of the fixing belt 64. In this state, the fixing nip N2 is formed at pressure-contact portions of the pressure roller 61 and the fixing belt 64.

Each of the pressure roller 61 and the fixing roller 62 includes for example a core metal and an elastic layer covering the outer periphery of the core metal. The heating roller 63 includes a core metal and a heater 65 placed therein. The fixing belt 64 is an endless belt member wound around the fixing roller 62 and the heating roller 63. The fixing belt 64 includes a base layer located on an innermost circumference, an outer layer located on an outermost circumference, and an elastic layer located between the base layer and the outer layer. The outer layer of the fixing belt 64 is made of fluorine contained resin and has high releasability.

During execution of the fixing process, the fixing roller 62 is driven to rotate counterclockwise as indicated by an arrow in FIG. 2 by a drive unit 66. By this rotation of the fixing roller 62, the pressure roller 61, the heating roller 63, and the fixing belt 64 are individually driven to rotate in respective directions indicated by arrows in FIG. 2.

During the fixing process, the heater 65 can heat the heating roller 63 to increase the temperature of the fixing belt 64. That is, during the fixing process, the fixing nip N2 is heated to a predetermined temperature. Accordingly, the sheet P is pressed under heating at the time of passing through the fixing nip N2. By this fixing process at the fixing nip N2, a toner image transferred onto the sheet P at the transfer nip N1 is fixed.

A portion of the fixing belt 64 corresponding to an exit area of the fixing nip N2 is reduced in curvature radius by pressure contact with the pressure roller 61. On this portion of the fixing belt 64 with a reduced curvature radius in the exit area of the fixing nip N2, a leading end of the sheet P having passed through the fixing nip N2 in a conveying direction separates, by its own rigidity, from the fixing belt 64. The sheet P separated from the fixing belt 64 will be conveyed downstream along the conveying path 50.

Next, one example of normal image forming operations to be executed by the image forming apparatus 1 in the present embodiment will be briefly explained. The following description shows one example of image forming operations to form color images by use of four color toners on a sheet(s) P stacked in the sheet feeding cassette 51.

For forming a color image, firstly, the intermediate transfer belt 30 and the photoconductors 11 for each color are rotated at predetermined circumferential speeds in the corresponding directions indicated by the arrows in FIG. 1. The outer peripheral surface of each photoconductor 11 is uniformly charged by the corresponding charger 12. The charged outer peripheral surface of each photoconductor 11 is irradiated with the light according to image data by the exposing device 13 to form an electrostatic latent image. Subsequently, each electrostatic latent image is developed by the corresponding developing device 14, and thus a toner image is formed on each photoconductor 11.

The toner images formed on the photoconductors 11 are transferred onto the intermediate transfer belt 30 by the primary transfer rollers 15 (Primary transfer). Thus, yellow, magenta, cyan, and black toner images are superimposed in this order on the intermediate transfer belt 30. The thus superimposed four-color toner image is conveyed to the transfer nip N1 by rotation of the intermediate transfer belt 30. On the other hand, residual toner that has not been transferred to the intermediate transfer belt 30 and remains on the photoconductor 11 even after the image passes the primary transfer roller 15 is scraped by the photoconductor cleaner 16 and removed from the photoconductor 11.

Meanwhile, the sheets P stacked in the sheet feeding cassette 51 are individually picked up from a topmost one and conveyed to the transfer nip N1 along the conveying path 50. The timing at which each sheet P enters the transfer nip N1 is adjusted by the resist rollers 53 so as to coincide with the timing at which the toner image on the intermediate transfer belt 30 enters the transfer nip N1. At the transfer nip N1, accordingly, the superimposed four-color toner image is transferred to the sheet P (Secondary transfer).

The sheet P with the toner image transferred thereon is further conveyed to a downstream side of the conveying path 50. Specifically, the sheet P is fixed with the toner image by the fixing device 60 and then is ejected to the sheet output part 55 by the ejecting rollers 54. It is to be noted that untransferred residual toner remaining on the intermediate transfer belt 30 even after passing through the transfer nip N1 is collected by the belt cleaner 41 in the collecting section 42, and finally removed from the intermediate transfer belt 30.

Figure 3:
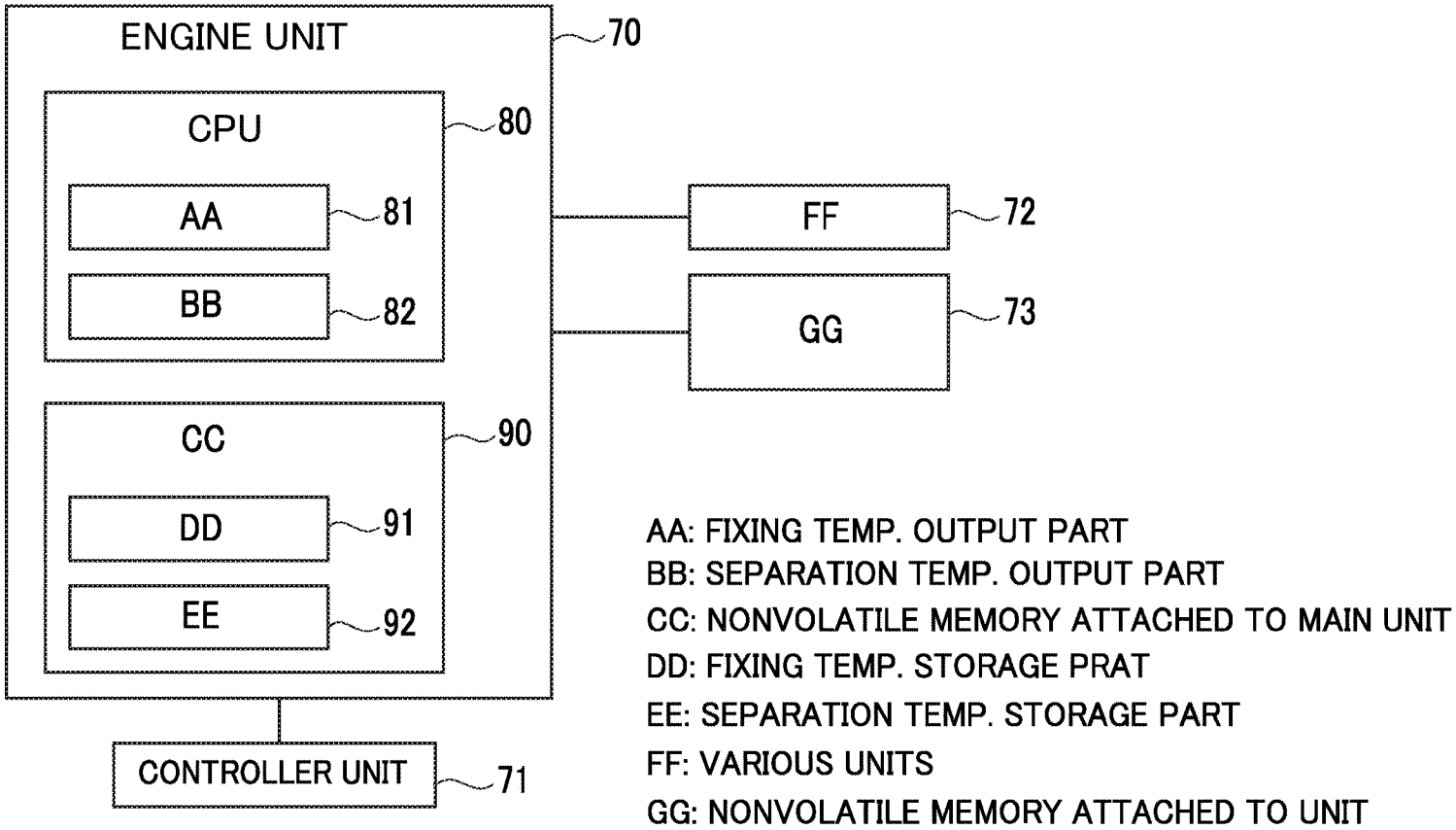
FIG. 3 is a schematic diagram of a control structure of the image forming apparatus in the embodiment.

FIG. 3 schematically shows a control structure of the image forming apparatus 1. The image forming apparatus 1 includes an engine unit 70 and a controller unit 71 to control each part. The engine unit 70 has a CPU 80 for performing the overall control process and a nonvolatile memory 90 attached to a main unit of the apparatus.

The nonvolatile memory 90 stores in advance various values to be used for image forming or others in the image forming apparatus 1. For example, the stored values include a system speed corresponding to the speed for conveying a sheet P and a formed toner image. The nonvolatile memory 90 in the present embodiment includes a fixing temperature storage part 91 and a separation temperature storage part 92. The fixing temperature storage part 91 stores a fixing temperature table shown in FIG. 4. The separation temperature storage part 92 stores a separation temperature table shown in FIG. 5. These fixing temperature table and separation temperature table will be explained in detail later.

The CPU 80 controls each part in the image forming apparatus 1 based on the values stored in the nonvolatile memory 90. For instance, the timing of starting to form each electrostatic latent image by use of the exposing device 13 is adjusted to form a color toner image with no displacement on the intermediate transfer belt 30. The CPU 80 controls the image forming apparatus 1 to adjust the timing of forming an image by use of the image forming units 10Y, 10M, 10C, and 10K and the timing of feeding a sheet P from the cassette 51, thereby making their timings of entering the transfer nip N1. The CPU 80 can further control the heating temperature of the heater 65, the speed of rotating the fixing roller 62 by the drive unit 66, the pressing force of the press unit 67, and others.

The CPU 80 includes a fixing temperature output part 81 and a separation temperature output part 82. The fixing temperature output part 81 in the present embodiment can output a fixing temperature which is a temperature required to fix a toner image on a sheet P based on the fixing temperature table stored in the fixing temperature storage part 91. The separation temperature output part 82 in the present embodiment can output a separation temperature at which the sheet P is appropriately separated from the fixing belt 64 based on the separation temperature table stored in the separation temperature storage part 92. The CPU 80 in the present embodiment determines a set temperature at the fixing nip N2 during a time period in which a sheet P passes through the fixing nip N2, based on the fixing temperature output from the fixing temperature output part 81 and the separation temperature output from the separation temperature output part 82. These fixing temperature, separation temperature, set temperature at the fixing nip N2, and others will be explained in detail later.

The engine unit 70 controls various units 72 included in the image forming apparatus 1 and also performs writing and reading operations with respect to a nonvolatile memory or memories 73 attached to various units. The various units 72 include an imaging unit, for example. Of the nonvolatile memories 73 attached to the various units 72, for example, a memory attached to the imaging unit stores the number of sheets formed with images by the imaging unit.

The controller unit 71 is connected to an external personal computer or the like and configured to receive a command input therefrom. For instance, when the controller unit 71 receives a command signal for image formation from a personal computer, an image forming job is generated in the image forming apparatus 1. Furthermore, the engine unit 70 and the controller unit 71 perform communications on various information such as a dot counter value.

Next, the fixing temperature table stored in the fixing temperature storage part 91 and the fixing temperature output by the fixing temperature output part 81 will be explained. The fixing temperature table in FIG. 4 shows fixing temperatures which are temperatures determined in advance so that a toner image carried on a sheet P can be appropriately fixed on the sheet P in the fixing device 60. The fixing temperature table, as shown in FIG. 4, includes relationships between the fixing temperature, the toner density (concentration) of the toner image carried on the sheet P, and the grammage (basis weight) of the sheet P. That is, the fixing temperature table shows the fixing temperature for each toner density of the toner image carried on the sheet P and for each grammage of the sheet P.

Specifically, the fixing temperature table shows the fixing temperatures required to appropriately fix the toner image on the sheet P for each toner density of the toner image carried on the sheet P and each grammage of the sheet P. For example, in the fixing temperature table in the present embodiment, when the toner density of the toner image carried on the sheet P is low and further the grammage of the sheet P is low, the fixing temperature is 160° C. In this case where the toner density of the toner image carried on the sheet P is low and the grammage of the sheet P is low, the fixing process at a temperature of 160° C. or more can appropriately fix the toner image on the sheet P. The fixing temperature table is obtained in advance for example by experiments performed using the fixing device 60.

In the fixing temperature table in FIG. 4, the fixing temperature is higher as the toner density is higher. To excellently fix the toner image carried on the sheet P to the sheet P, it is necessary to appropriately heat the sheet P carrying the toner image according to the toner density corresponding to an adhesion amount of the toner forming the toner image carried on the sheet P. This is because, if a heat amount by heating is not sufficient, the toner could not be fused well and fixing failure of the toner image may be caused. Specifically, for good fixing process, the temperature at the fixing nip N2 during passage of the sheet P therethrough needs to be raised as the toner density of the toner image is higher.

In the fixing temperature table in FIG. 4, the fixing temperature is lower as the grammage of the sheet P is lower. The amount of heat conducted from the fixing device 60 while the sheet P passes through the fixing nip N2 is larger as the grammage is higher. Accordingly, for good fixing process, it is preferable that the higher the grammage of the sheet P, the higher the temperature at the fixing nip N2. Another reason is because a sheet P with a low grammage can be subjected to good fixing process even if the temperature is low.

The fixing temperature output part 81 in the present embodiment can obtain the toner density of the toner image carried on the sheet P, which is calculated by the CPU 80 from data of an image pattern in an image forming job. In addition, the grammage of the sheet P can be obtained from the type of the sheet P input by a user in the sheet type input unit 56. Therefore, based on the obtained toner density of the toner image carried on the sheet P and the obtained grammage of the sheet P, the fixing temperature output part 81 can determine the fixing temperature by referring to the fixing temperature table stored in the fixing temperature storage part 91. The fixing temperature output part 81 can output the determined fixing temperature.

The fixing temperature output part 81 in the present embodiment is configured to determine and output the fixing temperature for each of a first area X1 and a second area X2 of the sheet P divided into two in the conveying direction. The CPU 80 in the present embodiment calculates the toner density of an image pattern to be formed in each of the first area X1 and the second area X2. The fixing temperature output part 81 can determine the fixing temperature for the first area X1 and the fixing temperature for the second area X2 based on the toner density in the first area X1 and the toner density in the second area X2.

The toner density is not always uniformly equal over each of the first area X1 and the second area X2. The CPU 80 in the present embodiment therefore uses a representative value of the toner density in each of the first area X1 and the second area X2. Specifically, the CPU 80 in the present embodiment uses an average value of the toner density calculated from the image pattern in each area as the representative value of the toner density in each of the first area X1 and the second area X2. For instance, the toner density in the first area X1 can be calculated by averaging up toner density values in further divided areas of the first area X1.

The fixing device 60 in the present embodiment performs the fixing process at the temperature higher than the fixing temperature determined by the fixing temperature output part 81, thereby enabling to suppress fixing failure of a toner image. Specifically, the temperature at the fixing nip N2 while a sheet P passes through the fixing nip N2 is set equal to or higher than the fixing temperature determined by the fixing temperature output part 81, so that the toner image carried on the sheet P can be appropriately fixed on the sheet P. In the present embodiment, the CPU 80 is a leading-end toner value output part and a rear-side toner value output part. In the present embodiment, the fixing temperature output part 81 is a leading-end fixing value output part and a rear-side fixing value output part.

The following explanation will be given to the separation temperature table stored in the separation temperature storage part 92 and the separation temperature to be output from the separation temperature output part 82. The separation temperature table in FIG. 5 shows the separation temperature determined in advance to allow a sheet P having passed through the fixing nip N2 to be appropriately separated from the fixing belt 64. As shown in FIG. 5, the separation temperature table shows relationships between the separation temperature, the toner density of a toner image carried on the sheet P, and the grammage of the sheet P. That is, the separation temperature table shows the separation temperature for each toner density of a toner image carried on a sheet P and for each grammage of the sheet P.

The separation temperature table shows the separation temperature required to appropriately separate a sheet P having passed through the fixing nip N2 from the fixing belt 64 for each toner density of the toner image carried on the sheet P and each grammage of the sheet P. In the separation temperature table in the present embodiment, for instance, when the toner density of a toner image carried on a sheet P is low and the grammage of the sheet P is low, the separation temperature is 170° C. In this case where the toner density of a toner image carried on a sheet P is low and the grammage of the sheet P is low, the fixing process at a temperature of 170° C. or higher can appropriately separate the sheet P having passed through the fixing nip N2 from the fixing belt 64. The separation temperature table is obtained in advance for example by experiments using the fixing device 60.

In the separation temperature table in FIG. 5, the separation temperature is higher as the toner density is higher. Toner particles contain wax which will seep out when toner is heated. The wax that seeps out from the toner particles of a toner image allows a sheet P to easily separate from the fixing belt 64. At the time when the sheet P in which the wax sufficiently seeps out from the toner particles of the toner image reaches the portion of the fixing belt 64 with the small curvature radius in the exit area of the fixing nip N2, the sheet P can be appropriately separated from the fixing belt 64.

Specifically, for good separation of the sheet P from the fixing belt 64, it is necessary to appropriately heat the sheet P carrying thereon the toner image according to the toner density of the toner image carried on the sheet P. The reason is because, when the heat amount by heating is not sufficient, the wax could not seep out of the toner particles and thus a sheet P having passed through the fixing nip N2 may remain stuck to the fixing belt 64. In other words, it is necessary for good separation of a sheet P from the fixing belt 64 to increase the temperature at the fixing nip N2 while the sheet P passes through the fixing nip N2 as the toner density of the toner image is higher.

In the separation temperature table in FIG. 5, the separation temperature is lower as the grammage is higher. In general, a sheet P having a higher grammage is thicker. Accordingly, the higher the grammage, the larger the rigidity of a sheet P is. Specifically, a sheet P with a higher grammage has larger rigidity and thus provides a larger force to separate from the fixing belt 64 when the sheet P reaches the exit area of the fixing nip N2.

Therefore, a sheet P having a high grammage to some extent tends to easily separate from the fixing belt 64 even if the wax does not sufficiently seep out from the toner particles. This is because as the grammage of the sheet P is higher, a toner heating temperature needs not to be high. In the present embodiment, as shown in the separation temperature table in FIG. 5, when the grammage is high, the separation temperature is zero irrespective of the toner density. This is because a sheet P having a high grammage can appropriately separate from the fixing belt 64 as long as the temperature at the fixing nip N2 is in a normal fixing temperature range.

The separation temperature output part 82 in the present embodiment can also obtain a toner density of a toner image carried on a sheet P from the CPU 80. Furthermore, the separation temperature output part 82 can further obtain the grammage of the sheet P from the type of the sheet P input by a user in the sheet type input unit 56. Accordingly, based on the obtained toner density of the toner image carried on the sheet P and the obtained grammage of the sheet P, the separation temperature output part 82 can determine the separation temperature by referring to the separation temperature table stored in the separation temperature storage part 92. The separation temperature output part 82 can output the determined separation temperature.

The separation temperature output part 82 in the present embodiment is configured to determine and output a separation temperature for a leading area Y which is an area determined in advance as an area including a leading end of a sheet P in the conveying direction. The CPU 80 in the present embodiment calculates the toner density of an image pattern to be formed in the leading area Y. For the leading area Y, the CPU 80 in the present embodiment also uses a representative value of the toner density and calculates the representative value from the average value of the toner density. The separation temperature output part 82 can further determine the separation temperature for the leading area Y based on the toner density in the leading area Y.

The fixing device 60 in the present embodiment can perform the fixing process at a temperature set equal to or higher than the separation temperature determined by the separation temperature output part 82, thereby enabling to suppress separation failure of the sheet P. Specifically, when the temperature at the fixing nip N2 while the leading area Y of the sheet P passes through the fixing nip N2 is set equal to or higher than the separation temperature determined by the separation temperature output part 82, the sheet P having passed through the fixing nip N2 can be appropriately separated from the fixing belt 64.

As the toner density in the leading area Y, a common value to the toner density in the first area X1 may be used. An alternative may be arranged to calculate an average value from the toner density in each area set by dividing only the leading area Y into a plurality of areas, and use the calculated value as the toner density in the leading area Y. The separation temperature is set only for the leading area Y. This is because as long as the leading area Y of the sheet P appropriately separates from the fixing belt 64, a rear area following the leading area Y in the conveying direction can also be appropriately separated. In the present embodiment, the separation temperature output part 82 is a leading-end separation value output part.

In the present embodiment, an actual set temperature at the fixing nip N2 in the fixing device 60 during the fixing process is determined based on the fixing temperature output from the fixing temperature output part 81 and the separation temperature output from the separation temperature output part 82. This procedure will be explained below with reference to FIG. 6.

Figure 6:
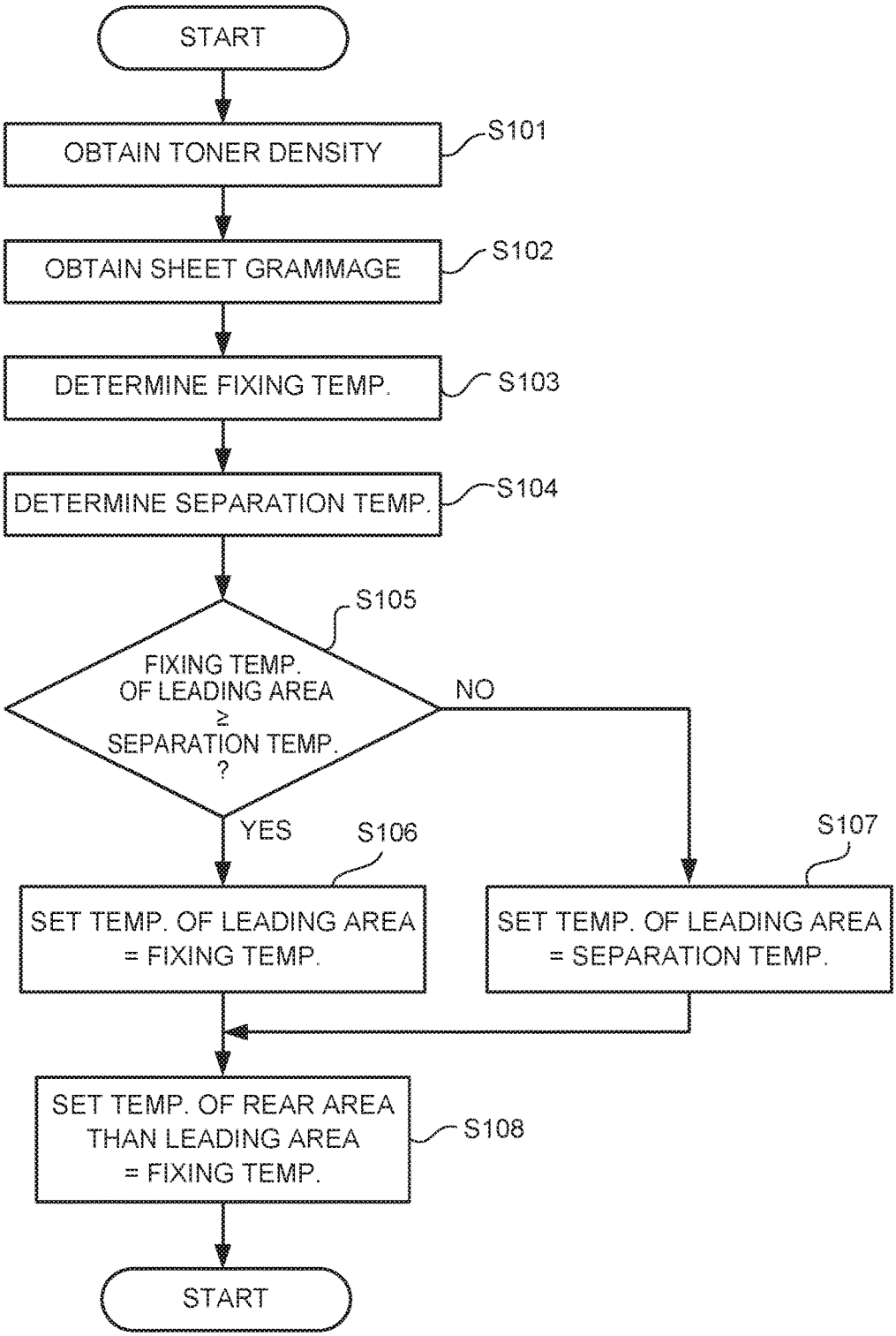
FIG. 6 is a flowchart showing a procedure for determining a set temperature at a fixing nip.

FIG. 6 is a flowchart showing how to determine the set temperature at the fixing nip N2 in the fixing device 60 in the present embodiment. As shown in FIG. 6, when an image forming job is input to the image forming apparatus 1, the fixing temperature output part 81 and the separation temperature output part 82 firstly obtain the toner density of an image to be formed based on an image pattern of the image forming job (S101).

Figure 7:
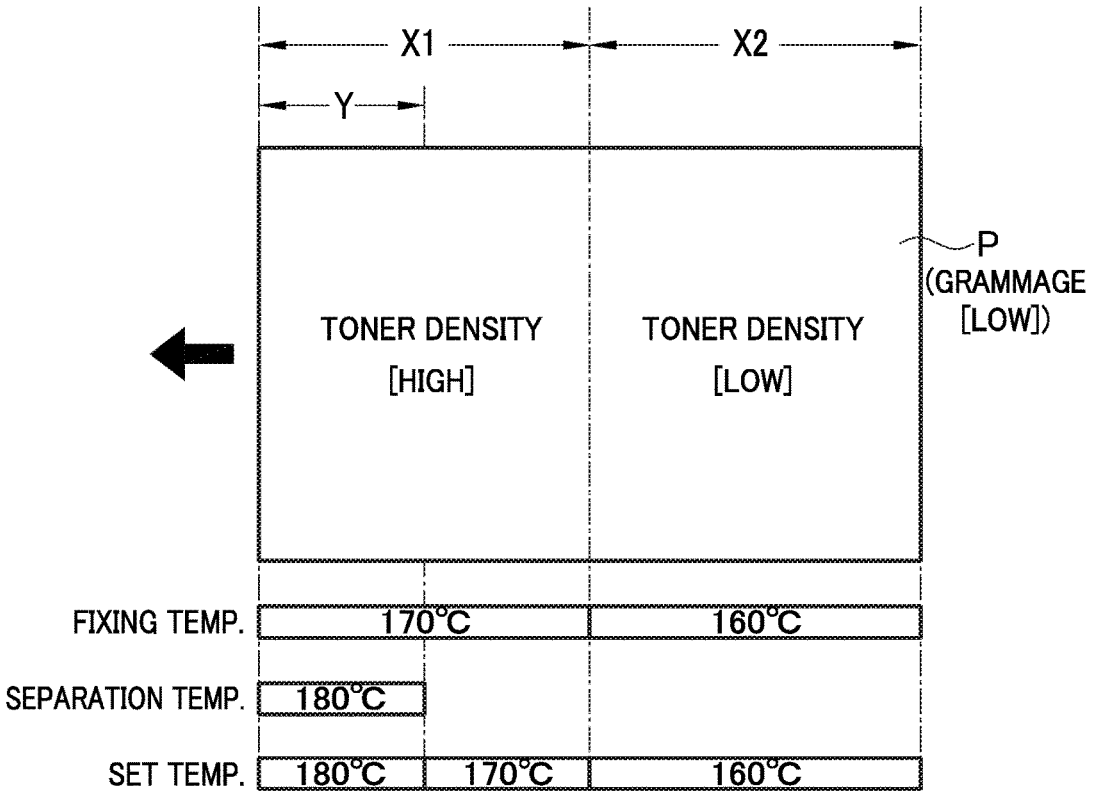
FIG. 7 is a diagram showing one example of the set temperature at the fixing nip in a first embodiment.

In an example of the image pattern shown in FIG. 7, for example, the toner density in the first area X1 in the sheet P is high, while the toner density in the second area X2 is low. In this case, the fixing temperature output part 81 obtains that the toner density in the first area X1 is high and the toner density in the second area X2 is low. The separation temperature output part 82 obtains that the toner density in the leading area Y is high.

Subsequently, the fixing temperature output part 81 and the separation temperature output part 82 obtains the grammage according to the type of the sheet P output from the sheet type input unit 56 (S102). In the example in FIG. 7, the sheet P used in image formation has a low grammage. Thus, both the fixing temperature output part 81 and the separation temperature output part 82 obtain that the grammage of the sheet P is low.

Successively, the fixing temperature output part 81 refers to the fixing temperature table stored in the fixing temperature storage part 91 based on the obtained toner density and the obtained grammage and determines the fixing temperature (S103). In the example in FIG. 7, specifically, the fixing temperature output part 81 refers to the fixing temperature table in FIG. 4 based on the obtained toner density and the obtained grammage, and determines the fixing temperature for the first area X1 to be 170° C. and the fixing temperature for the second area X2 to be 160° C.

The separation temperature output part 82 refers to the separation temperature table stored in the separation temperature storage part 92 based on the obtained toner density and the obtained grammage and determines the separation temperature (S104). In the example in FIG. 7, specifically, the separation temperature output part 82 refers to the separation temperature table in FIG. 5 based on the obtained toner density and the obtained grammage, and determines the separation temperature for the leading area Y to be 180° C.

Next, the leading area Y is subjected to comparison between the fixing temperature and the separation temperature (S105). The fixing temperature for the leading area Y is equal to the fixing temperature for the first area X1. If the fixing temperature for the leading area Y is equal to or higher than the separation temperature (S105: YES), the fixing temperature for the leading area Y is determined as the set temperature for the leading area Y (S106).

On the other hand, if the fixing temperature for the leading area Y is lower than the separation temperature (S105: NO), the separation temperature is determined as the set temperature for the leading area Y (S107). In the fixing device 60 in the present embodiment, specifically, when the fixing temperature for the leading area Y is lower than the separation temperature, the separation control is executed in which the fixing process is performed on the leading area Y at a temperature equal to or higher than the separation temperature.

In the example in FIG. 7, the fixing temperature for the leading area Y is 170° C. and the separation temperature for the leading area Y is 180° C. Thus, this separation temperature, 180° C., higher than the fixing temperature, is set as the set temperature for the leading area Y at the fixing nip N2.

For a portion located on a more rear side than the leading area Y in the conveying direction, the fixing temperature is set as the set temperature at the fixing nip N2 (S108). In the example in FIG. 7, specifically, for the portion of the first area X1 on the more rear side than the leading area Y, a set temperature at the fixing nip N2 is set to 170° C. Furthermore, for the second area X2, a set temperature at the fixing nip N2 is set to 160° C.

Subsequently, the fixing device 60 performs an actual fixing process at the determined set temperature. In the example in FIG. 7, specifically, the heating temperature of the heater 65 is controlled so that the temperature at the fixing nip N2 is 180° C. during the interval that the leading area Y of the sheet P is passing through the fixing nip N2. Further, the heating temperature of the heater 65 is controlled so that the temperature at the fixing nip N2 is 170° C. during the interval that the portion on the more rear side than the leading area Y in the first area X1 of the sheet P is passing through the fixing nip N2. In addition, the heating temperature of the heater 65 is controlled so that the temperature at the fixing nip N2 is 160° C. during the interval that the second area X2 of the sheet P is passing through the fixing nip N2.

Consequently, in the example in FIG. 7, fixing failure of the toner image can be suppressed. Specifically, the first area X1 of the sheet P is heated at the fixing temperature of 170° C. or higher at the fixing nip N2. The second area X2 of the sheet P is heated at the fixing temperature of 160° C. at the fixing nip N2. Since the temperature at the fixing nip N2 during passage of the sheet P through the fixing nip N2 is equal to or higher than the fixing temperature determined by the fixing temperature output part 81, the toner image carried on the sheet P can be appropriately fixed to the sheet P.

In the example in FIG. 7, furthermore, separation failure of the sheet P can also be suppressed. Specifically, the leading area Y of the sheet P is heated at the separation temperature of 180° C. at the fixing nip N2. That is, while the leading area Y of the sheet P is passing through the fixing nip N2, the temperature at the fixing nip N2 is equal to or higher than the separation temperature determined by the separation temperature output part 82. Thus, the sheet P having passed through the fixing nip N2 can be smoothly separated from the fixing belt 64.

In addition, as shown in FIG. 7, the fixing device 60 in the present embodiment can perform the fixing process at the fixing temperature required to appropriately fix a toner image carried on the sheet P on the more rear side than the leading area Y of the sheet P. Thus, it is possible to suppress fixing failure and separation failure and also reduce the heating temperature of the heater 65. Accordingly, the fixing device 60 in the present embodiment can reduce the heating temperature and thereby cut down power consumption.

Figure 8:
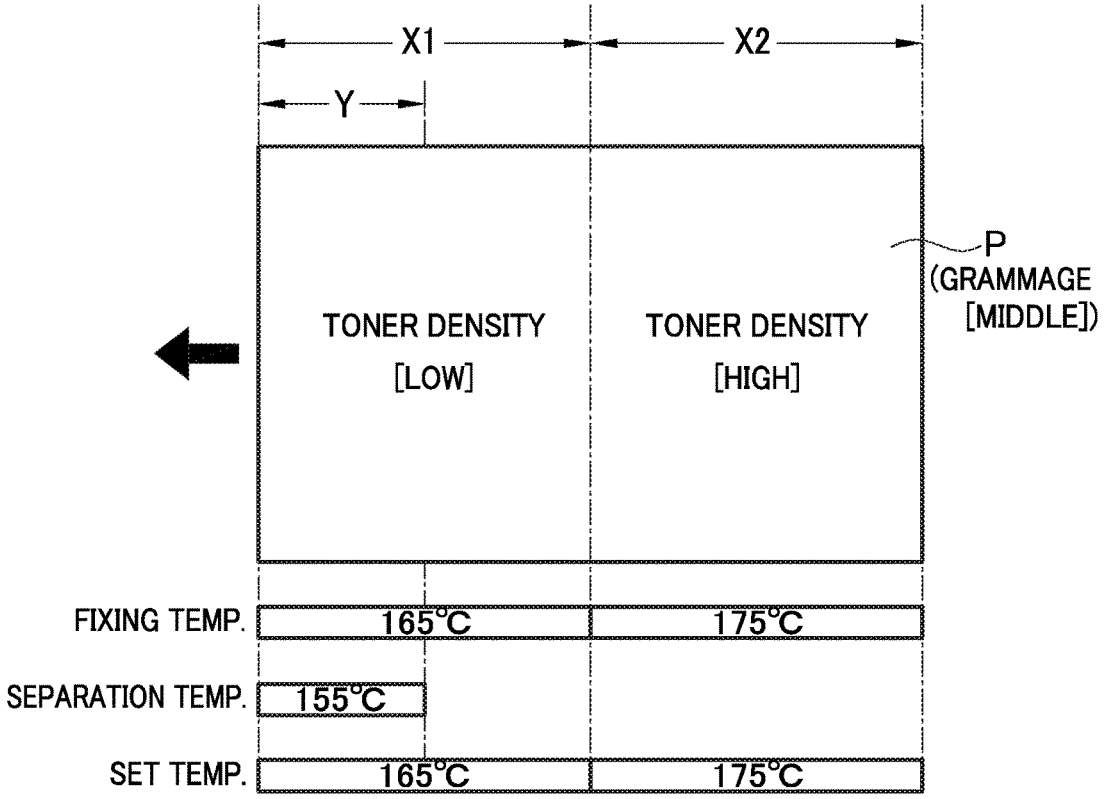
FIG. 8 is a diagram showing another example, different from that in FIG. 7, of the set temperature at the fixing nip in the first embodiment.

FIG. 8 shows an example of an image pattern different from that in FIG. 7. Regarding this image pattern in FIG. 8, it is also possible to suppress fixing failure of a toner image and further suppress separation failure of a sheet P.

In the image pattern in FIG. 8, specifically, the fixing temperature output part 81 first obtains that the toner density in the first area X1 is low and the toner density in the second area X2 is high (S101). The separation temperature output part 82 obtains that the toner density in the leading area Y is low (S101). In the example in FIG. 8, both the fixing temperature output part 81 and the separation temperature output part 82 obtain that the grammage of the sheet P is medium (S102).

Successively, by referring to the fixing temperature table in FIG. 4 based on the obtained toner density and the obtained grammage, the fixing temperature output part 81 determines the fixing temperature for the first area X1 to be 165° C. and the fixing temperature for the second area X2 to be 175° C. (S103). By referring to the separation temperature table in FIG. 5 based on the obtained toner density and the obtained grammage, the separation temperature output part 82 determines the separation temperature for the leading area Y to be 155° C. (S104).

In the example in FIG. 8, the fixing temperature in the toner image Y is 165° C. and the separation temperature in the leading area Y is 155° C. Thus, they are compared (S105) and the fixing temperature, 165° C., higher than the separation temperature, is set as the set temperature at the fixing nip N2 for the leading area Y (S106).

The set temperature at the fixing nip N2 for a portion of the first area X1 located on a more rear side than the leading area Y is set to 165° and the set temperature at the fixing nip N2 for the second area X2 is set to 175° C. (S108). In other words, in the example in FIG. 8, the set temperatures at the fixing nip N2 for both the first area X1 including the leading area Y and the second area X2 are determined as the fixing temperature.

Subsequently, the fixing device 60 performs an actual fixing process at the determined set temperatures. In the example in FIG. 8, specifically, the heating temperature of the heater 65 is controlled so that the temperature at the fixing nip N2 is 165° C. during the interval that the leading area Y of the sheet P is passing through the fixing nip N2. Similarly, the heating temperature of the heater 65 is controlled so that the temperature at the fixing nip N2 is 165° C. during the interval that the portion on the more rear side than the leading area Y in the first area X1 of the sheet P is passing through the fixing nip N2. In addition, the heating temperature of the heater 65 is controlled so that the temperature at the fixing nip N2 is 175° C. during the interval that the second area X2 of the sheet P is passing through the fixing nip N2.

Consequently, also in the example in FIG. 8, the first area X1 of the sheet P is heated at the fixing nip N2 at 165° C. corresponding to the fixing temperature. The second area X2 of the sheet P is heated at the fixing nip N2 at 175° C. corresponding to the fixing temperature. Accordingly, since the temperature at the fixing nip N2 while the sheet P is passing through the fixing nip N2 is equal to or higher than the fixing temperature determined by the fixing temperature output part 81, the toner image carried on the sheet P can be appropriately fixed to the sheet P.

In the example in FIG. 8, the leading area Y of the sheet P is heated at the fixing nip N2 at 155° C. corresponding to the separation temperature or higher. Thus, since the temperature at the fixing nip N2 while the leading area Y of the sheet P is passing through the fixing nip N2 is equal to or higher than the separation temperature determined by the separation temperature output part 82, the sheet P having passed through the fixing nip N2 can be appropriately separated from the fixing belt 64.

In the present embodiment, the length of the leading area Y of the sheet P in the conveying direction is preferably set to be equal to or more than the length of the fixing nip N2 in the conveying direction of a sheet P. Since the length of the leading area Y of the sheet P is set equal to or longer than the length of the fixing nip N2, the leading end of the sheet P can be reliably separated from the fixing belt 64. The length of the leading area Y of the sheet P in the conveying direction is preferably set to be equal to or shorter than a quarter of the total length of the sheet P in the conveying direction. If the length of the leading area Y is too long, the temperature at the fixing nip N2 has to be maintained at the separation temperature higher than the fixing temperature for a long time in the separation control by such a too long length. This may cause an increase in power consumption for heating.

In the present embodiment, when the fixing temperature for the leading area Y is lower than the separation temperature, the separation control is executed by setting the set temperature for the leading area Y of the sheet P to the separation temperature, thereby enhancing separation performance of the leading area Y of the sheet P from the fixing belt 64. However, the sheet P tends to more easily separate from the fixing belt 64 as the pressure contact strength at the fixing nip N2 is higher. This is because a higher pressure contact strength at the fixing nip N2 can provide a smaller curvature radius in the exit area of the fixing nip N2.

Accordingly, when the fixing temperature for the leading area Y is lower than the separation temperature, the set temperature for the leading area Y of the sheet P may be set to the fixing temperature and the separation control may be executed by adjusting the pressure contact strength of the leading area Y to be higher than normal while the leading area Y is passing through the fixing nip N2. This separation control using adjustment of the pressure contact strength at the fixing nip N2 can be performed by adjusting the pressing force of the pressure roller 61 driven by the press unit 67.

For instance, when the fixing temperature is higher than the separation temperature, the press unit 67 is controlled to press the pressure roller 61 at a first predetermined pressing force while the leading area Y of the sheet P is passing through the fixing nip N2. When the fixing temperature is lower than the separation temperature, the separation control can be performed by adjusting the pressing force generated by the press unit 67 during passage of the leading area Y of the sheet P through the fixing nip N2 to a second pressing force higher than the first pressing force.

Furthermore, for instance, the sheet P tends to more easily separate from the fixing belt 64 as the conveying speed of the sheet P when passing through the fixing nip N2 is slower. This tendency comes from that, when the time for the sheet P to pass through the fixing nip N2 is longer, the sheet P receives a larger amount of heat during passage through the fixing nip N2, so that much wax is caused to seep out of toner particles.

Thus, when the fixing temperature for the leading area Y is lower than the separation temperature, the set temperature for the leading area Y of the sheet P may be set to the fixing temperature and the separation control may be executed by adjusting the conveying speed of the sheet P to be slower than normal while the leading area Y is passing through the fixing nip N2. This separation control using adjustment of the conveying speed at the fixing nip N2 can be achieved by adjusting the rotational speed of the fixing roller 62 driven by the drive unit 66.

For instance, when the fixing temperature is higher than the separation temperature, the drive unit 66 rotates the fixing roller 62 at a first predetermined rotational speed while the leading area Y of the sheet P is passing through the fixing nip N2. When the fixing temperature is lower than the separation temperature, the separation control can be performed by adjusting the rotational speed of the fixing roller 62 while the leading area Y of the sheet P is passing through the fixing nip N2 to a second rotational speed slower than the first rotational speed.

As explained in detail above, the image forming apparatus 1 in the present embodiment includes the fixing device 60. In the fixing device 60, the separation control to separate the leading area Y from the fixing device 60 is executed when the fixing temperature for the leading area Y is lower than the separation temperature. To be concrete, in the separation control, for example, the fixing process is conducted on the leading area Y at the set temperature set to the separation temperature. When the fixing temperature for the leading area Y is higher than the separation temperature, the fixing process is performed on the leading area Y at the set temperature set to the fixing temperature. The set temperature for the leading area Y is therefore equal to or higher than the fixing temperature and also equal to or higher than the separation temperature. Accordingly, the fixing device and the image forming apparatus capable of appropriately separating a sheet having passed through a fixing nip without having any influence on an image to be formed.

Second Embodiment

A second embodiment will be explained below. In this second embodiment, different from the first embodiment, a set temperature at the fixing nip N2 is set in each area provided by dividing the leading area Y into a plurality of areas. In the second embodiment, the image forming apparatus 1 and the fixing device 60 are identical to those in the first embodiment.

In the second embodiment, the fixing temperature table stored in the fixing temperature storage part 91 is the same as in the first embodiment (FIG. 4). The fixing temperature output part 81 in the present embodiment also refers to the fixing temperature table in the fixing temperature storage part 91 based on a toner density of a toner image for image formation and a grammage of a sheet P and outputs a fixing temperature.

Figure 9:
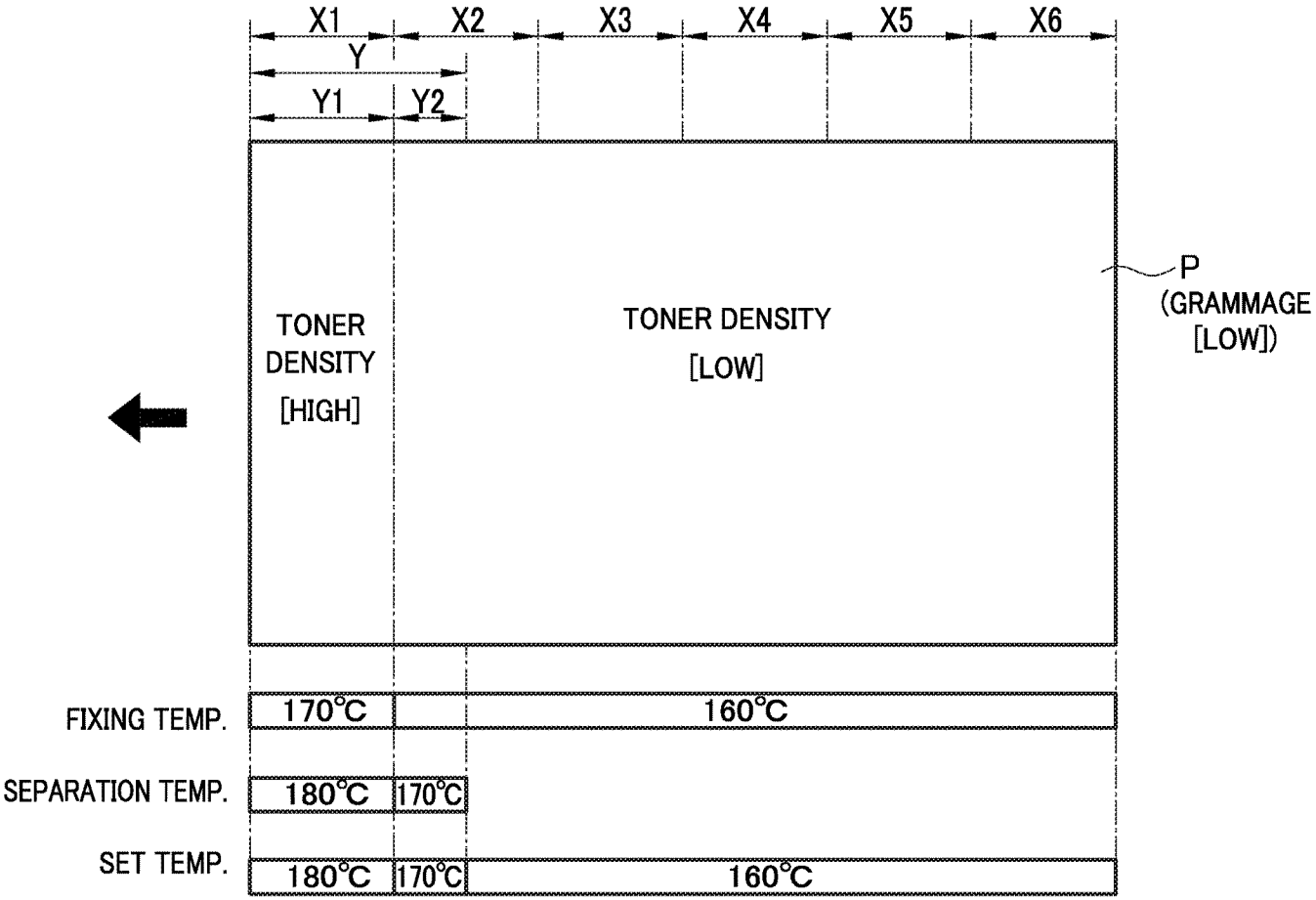
FIG. 9 is a diagram showing one example of a set temperature at a fixing nip in a second embodiment.

However, the fixing temperature output part 81 in the present embodiment is configured to determine and output a fixing temperature for each of a first area X1 to a sixth area X6 which are defined by dividing a sheet P into six areas in the conveying direction as shown in FIG. 9. Therefore, the CPU 80 in the present embodiment calculates a toner density in an image pattern to be formed in each of the first area X1 to the sixth area X6. In the present embodiment, the toner density may be defined by a value calculated from an average value. Furthermore, the fixing temperature output part 81 can determine each of the fixing temperatures for the first area X1 to sixth area X6 from each toner density of the first area X1 to the sixth area X6.

In the fixing device 60 in the present embodiment, similarly, the fixing process is performed at a temperature equal to or higher than the fixing temperature determined by the fixing temperature output part 81, thereby enabling to suppress fixing failure of the toner image. Specifically, since the temperature at the fixing nip N2 while the sheet P is passing through the fixing nip N2 is set to equal to or higher than the fixing temperature determined by the fixing temperature output part 81, the toner image carried on the sheet P can be appropriately fixed to the sheet P.

Further, the separation temperature table stored in the separation temperature storage part 92 is also the same as that in the first embodiment (FIG. 5). The separation temperature output part 82 in the present embodiment is also configured to output the separation temperature by referring to the separation temperature table in the separation temperature storage part 92 based on the toner density of the toner image and the grammage of the sheet P for image formation.

However, the separation temperature output part 82 in the present embodiment determines and outputs the separation temperature for each of a first leading area Y1 and a second leading area Y2 which are defined by dividing the leading area Y of the sheet P into two as shown in FIG. 9. The toner densities of the first leading area Y1 and the second leading area Y2 may be defined by the values calculated from the average values by the CPU 80. In addition, the separation temperature output part 82 can determine the first leading area Y1 and the second leading area Y2 based on the toner densities of the first leading area Y1 and the second leading area Y2.

In the fixing device 60 in the present embodiment, the fixing process performed at a temperature equal to or higher than the separation temperature determined by the separation temperature output part 82 can also suppress separation failure of the sheet P. Specifically, since the temperature at the fixing nip N2 while the leading area Y of the sheet P is passing through the fixing nip N2 is set to equal to or higher than the separation temperature determined by the separation temperature output part 82, the sheet P having passed through the fixing nip N2 can be smoothly separated from the fixing belt 64.

In the present embodiment, further, the set temperature at the fixing nip N2 in the fixing device 60 can be determined by the procedure shown in the flowchart in FIG. 6. In the present embodiment, specifically, the procedure in FIG. 6 is performed for each of the first area X1 to the sixth area X6, the first leading area Y1, and the second leading area Y2.

To be concrete, in the image pattern in FIG. 9, the fixing temperature output part 81 first obtains that the toner density of the first area X1 is high and the toner density in each of the second area X2 to the sixth area X6 is low (S101). The separation temperature output part 82 obtains that the toner density of the first leading area Y1 is high and the toner density of the second leading area Y2 is low (S101). In the example in FIG. 9, both the fixing temperature output part 81 and the separation temperature output part 82 obtain that the grammage of the sheet P is low (S102).

Subsequently, the fixing temperature output part 81 refers to the fixing temperature table in FIG. 4 based on the obtained toner density and grammage and determines the fixing temperature for the first area X1 to be 170° C. and the fixing temperature for each of the second area X2 to the sixth area X6 to be 160° C. (S103). The separation temperature output part 82 refers to the separation temperature table in FIG. 5 based on the obtained toner density and grammage and determines the separation temperature for the first leading area Y1 to be 180° C. and the separation temperature for the second leading area Y2 to be 170° C. (S104).

In the example in FIG. 9, the fixing temperature for the first leading area Y1, i.e., the first area X1, is 170° C. The separation temperature for the first leading area Y1 is 180° C. Thus, these temperatures are compared (S105) and the separation temperature, 180° C., higher than the fixing temperature, is set as the set temperature at the fixing nip N2 for the first leading area Y1 (S107).

The fixing temperature for the second leading area Y2, i.e., the second area X2, is 160° C. The separation temperature for the second leading area Y2 is 170° C. Thus, these temperatures are compared (S105) and the separation temperature, 170° C., higher than the fixing temperature, is set as the set temperature at the fixing nip N2 for the second leading area Y2 (S107).

Furthermore, the set temperature at the fixing nip N2 for each of a remaining portion of the second area X2 on a more rear side than the leading area Y (the second leading area Y2) to the sixth area X6 is set to 160° C. corresponding to the fixing temperature (S108).

Subsequently, the fixing device 60 performs an actual fixing process at the determined set temperatures. In the example in FIG. 9, specifically, the heating temperature of the heater 65 is controlled so that the temperature at the fixing nip N2 is 180° C. while the first leading area Y1 of the sheet P is passing through the fixing nip N2. Further, the heating temperature of the heater 65 is controlled so that the temperature at the fixing nip N2 is 170° C. while the second leading area Y2 of the sheet P is passing through the fixing nip N2. Moreover, the heating temperature of the heater 65 is also controlled so that the temperature at the fixing nip N2 is 160° C. while a portion of the second area X2 located on a more rear side than the leading area Y in the sheet P to the sixth area X6 are continuously passing through the fixing nip N2.

In the fixing device 60 in the present embodiment, specifically, each of the first leading area Y1 and the second leading area Y2 defined by dividing the leading area Y into two is subjected to the separation control in which the fixing process is performed on the leading area Y at the separation temperature or higher when the fixing temperature is lower than the separation temperature.

In the example in FIG. 9 in the present embodiment, accordingly, every area from the first area X1 to the sixth area X6 of the sheet P is heated at the fixing temperature or higher at the fixing nip N2. Thus, since the temperature at the fixing nip N2 while the sheet P is passing through the fixing nip N2 is equal to or higher than the fixing temperature determined by the fixing temperature output part 81, the toner image carried on the sheet P can be appropriately fixed to the sheet P.

In the example in FIG. 9 in the present embodiment, furthermore, the leading area Y of the sheet P is heated at the separation temperature or higher at the fixing nip N2. Thus, since the temperature at the fixing nip N2 while the leading area Y of the sheet P is passing through the fixing nip N2 is equal to or higher than the separation temperature determined by the separation temperature output part 82, the sheet P having passed through the fixing nip N2 can be appropriately separated from the fixing belt 64.

In the present embodiment, moreover, the sheet P after passing through the fixing nip N2 can be reliably separated from the fixing belt 64. In other words, since the separation control can be individually performed on each of the first leading area Y1 and the second leading area Y2 of the sheet P, the heating temperature for separating each of the first leading area Y1 and the second leading area Y2 from the fixing belt 64 is less likely to be insufficient. In addition, the separation control performed on each of the first leading area Y1 and the second leading area Y2 can further reduce power consumption.

In the present embodiment, the separation control can also be executed by adjustment of the pressing force of the pressure roller 61 driven by the press unit 67 or by adjustment of the rotational speed of the fixing roller 62 driven by the drive unit 66. In these cases, adjusting the pressing force of the pressure roller 61 by the press unit 67 or adjusting the rotational speed of the fixing roller 62 by the drive unit 66 has only to be performed for each of the first leading area Y1 and the second leading area Y2.

In the present embodiment, as explained in detail above, when the fixing temperature is lower than the separation temperature, the first leading area Y1 and the second leading area Y2 defined by dividing the leading area Y are subjected to the separation control to separate the leading area Y from the fixing device 60. Concretely, in the separation control, for example, the fixing process is conducted on the first leading area Y1 and the second leading area Y2 at the set temperature set to the separation temperature. When the fixing temperature for each of the first leading area Y1 and the second leading area Y2 is higher than the separation temperature, the fixing process is performed on each of the first leading area Y1 and the second leading area Y2 at each set temperature set to the corresponding fixing temperature. The set temperature for the leading area Y is the fixing temperature or higher and also the separation temperature or higher. Accordingly, the fixing device and the image forming apparatus can be realized, capable of appropriately separating a sheet after passing through the fixing nip from the fixing device without having any influence on an image to be formed.

Third Embodiment

A third embodiment will be explained. In this embodiment, simulation is performed during continuous printing for continuously forming a plurality of images, in addition to the first embodiment. In this simulation, it is controlled so that the fixing nip N2 is heated to an appropriate set temperature by the time when the leading area Y of the sheet P reaches the fixing nip N2. In the present embodiment, the structures of the image forming apparatus 1 and the fixing device 60 are also identical to those in the first embodiment.

In the present embodiment, the fixing temperature storage part 91, the fixing temperature output part 81, the separation temperature storage part 92, and the separation temperature output part 82 are identical to those in the first embodiment. Further, when only one sheet P is to be subjected to image formation, this image formation is conducted by determining the set temperature at the fixing nip N2 through the procedure shown in FIG. 6 in a similar manner to that in the first embodiment.

In the present embodiment, for continuous printing to continuously form a plurality of images, the CPU 80 makes simulation in advance before executing the continuous printing. Specifically, the set temperature at the fixing nip N2 is determined based on each of the image patterns to be formed in a continuous printing job. The set temperature at the fixing nip N2 for each of the image patterns can be determined by the procedure shown in the flowchart in FIG. 6.

In addition, during the continuous printing, the CPU 80 in the present embodiment performs simulation to calculate the time (period) required to raise the temperature toward the set temperature for the leading area Y of a second sheet P2 which will pass through the fixing nip N2 after a first sheet P1. Based on the result of the simulation, the CPU 80 determines whether or not the timing (time point) of raising the temperature toward the set temperature for the leading area Y of the second sheet P2 needs to be advanced and executes an actual continuous printing job.

Figure 10:
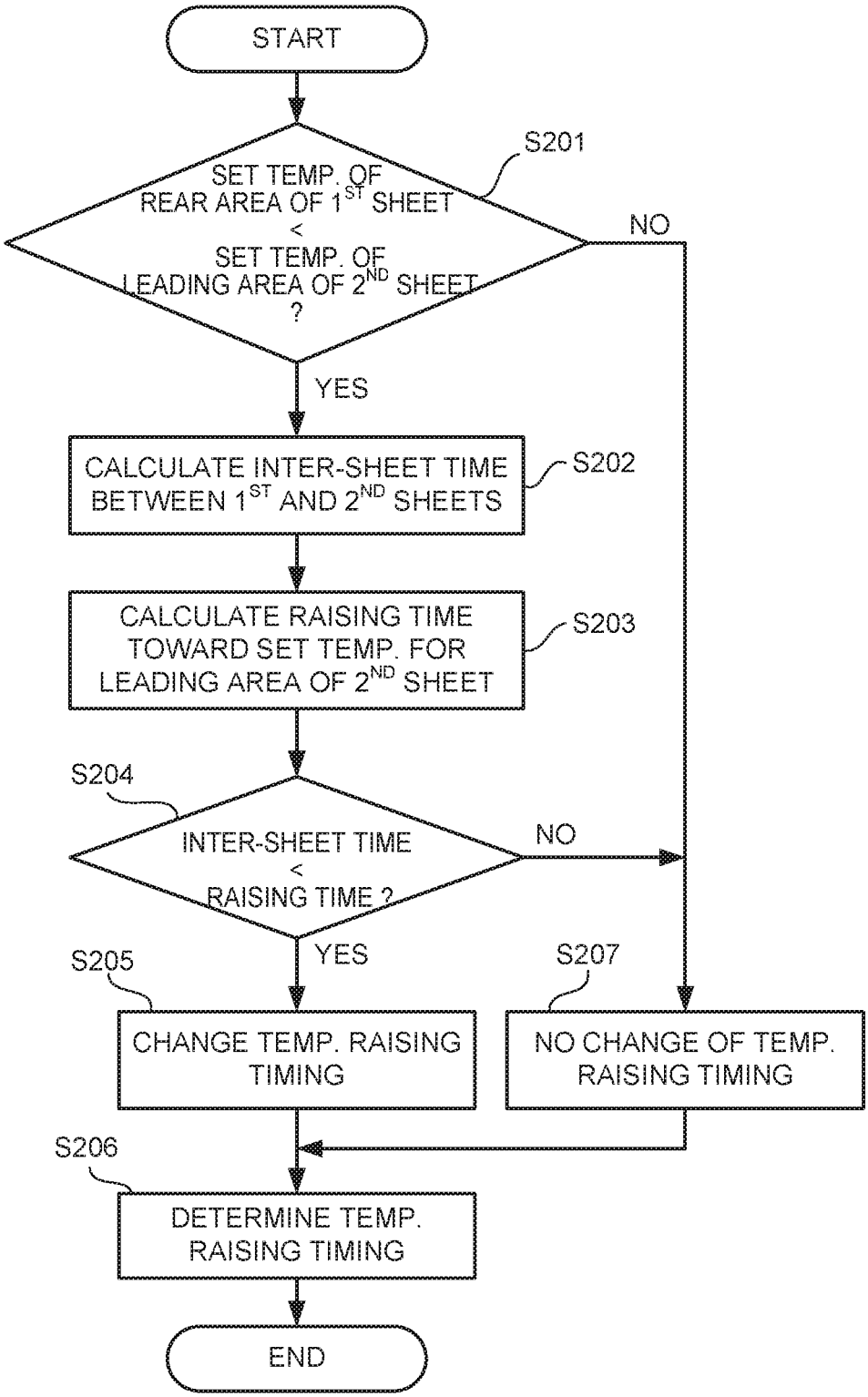
FIG. 10 is a flowchart showing a procedure for determining the timing for temperature raise in continuous printing.

The procedure for determining the temperature raising timing in the present embodiment will be explained referring to a flowchart in FIG. 10. The procedure in FIG. 10 is to be conducted when the continuous printing job is input. Prior to the steps in FIG. 10, for each image pattern in the continuous printing, a corresponding set temperature at the fixing nip N2 is determined by the procedure in FIG. 6.

Figure 11:
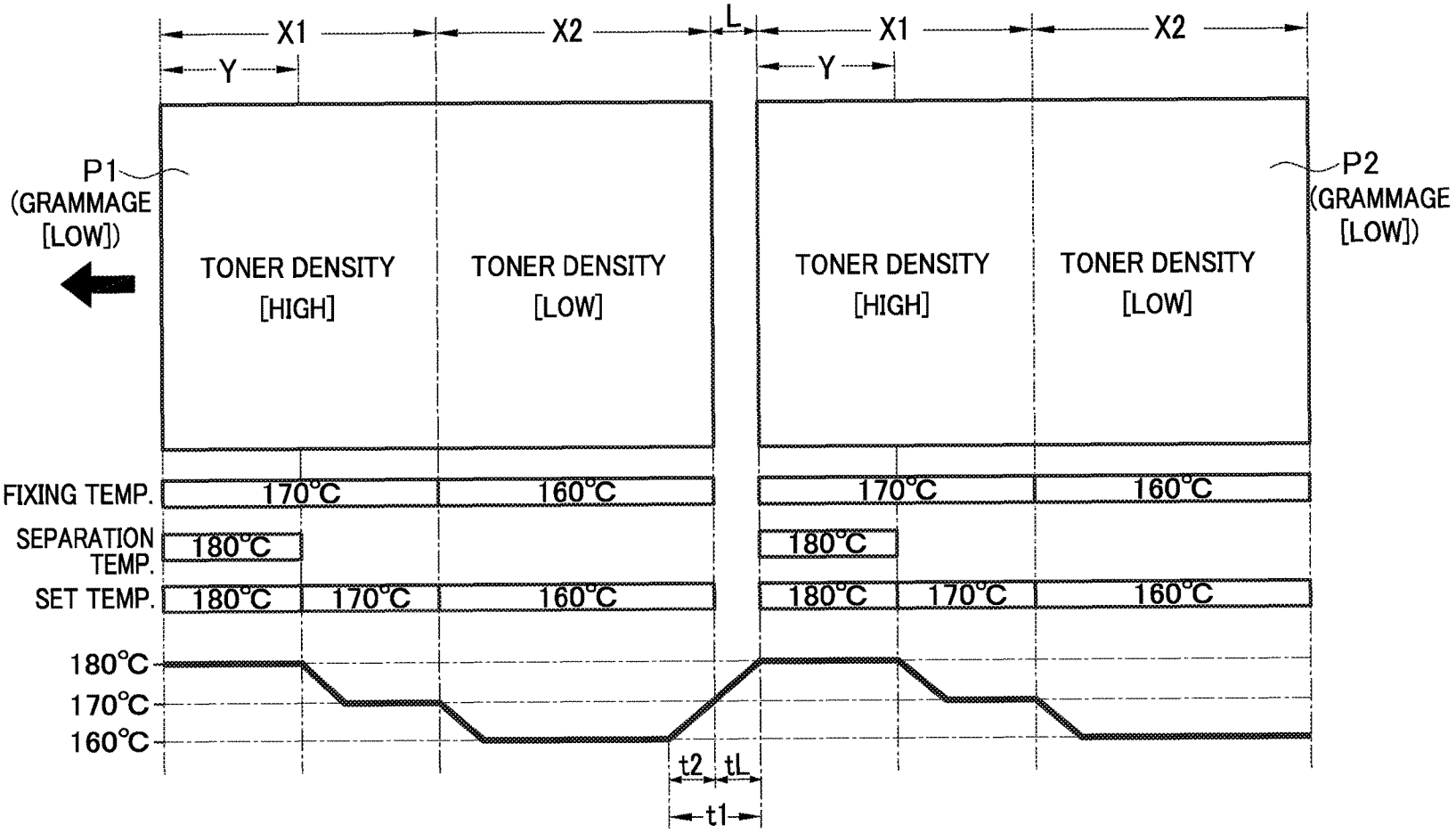
FIG. 11 is a diagram showing one example of a set temperature at a fixing nip in continuous printing in a third embodiment.

For example, FIG. 11 shows one example of a first sheet P1 in the continuous printing and a second sheet P2 which will pass through the fixing nip N2 after the first sheet P1. The set temperatures at the fixing nip N2 for the first sheet P1 and the second sheet P2 are individually determined by the procedure in FIG. 6.

As shown in FIG. 10, in the continuous printing, a comparison is made between a set temperature for a rear area of the first sheet P1 located on the more rear side than the leading area Y and a set temperature for a leading area Y of the second sheet P2 which will pass through the fixing nip N2 after the first sheet P1 (S201).

If the set temperature for the rear area of the first sheet P1 is lower than the set temperature for the leading area Y of the second sheet P2 (S201: YES), an inter-sheet time between the first sheet P1 and the second sheet P2 is calculated (S202). This inter-sheet time between the first sheet P1 and the second sheet P2 is an interval from the time when a rear end (a bottom edge) of the first sheet P1 passes through the fixing nip N2 to the time when a leading end (a top edge) of the second sheet P2 reaches the fixing nip N2. It is to be noted that the conveying speed of the sheets P, the timing of supplying the sheets P, and others are known values in design. From these values, accordingly, the inter-sheet time can be calculated.

Successively, the raising time (raising time period) toward the set temperature for the leading area Y of the second sheet P2 is calculated (S203). That is, the time required to increase the temperature at the fixing nip N2 from the set temperature for the rear area of the first sheet P1 to the set temperature for the leading area Y of the second sheet P2 is calculated by simulation.

If the inter-sheet time between the first sheet P1 and the second sheet P2 is shorter than the time period for temperature raise toward the set temperature for the leading area Y of the second sheet P2 (S204: YES), it is determined that the timing of raising the temperature is to be changed (S205). In this case, even when the temperature at the fixing nip N2 is increased after the rear end of the first sheet P1 passes through the fixing nip N2, it is impossible to raise the temperature at the fixing nip N2 to the set temperature for the leading area Y of the second sheet P2 by the time when the leading end of the second sheet P2 reaches the fixing nip N2. Accordingly, it is determined that heating has to be started before the rear end of the first sheet P1 passes through the fixing nip N2 in order to raise the temperature at the fixing nip N2 toward the set temperature for the leading area Y of the second sheet P2.

The time required for temperature raise is a known value by the simulation in the foregoing step S203. The time when the leading end of the second sheet P2 reaches the fixing nip N2 by conveyance is also a known value. Accordingly, the timing of starting the temperature raise at the fixing nip N2 can be determined based on those known values (S206).

On the other hand, when the set temperature for the rear area of the first sheet P1 is equal to or higher than the set temperature for the leading area Y of the second sheet P2 (S201: NO), it is unnecessary to raise the temperature at the fixing nip N2 toward the set temperature for the leading area Y of the second sheet P2. That is, the temperature raising timing does not need to be changed. Even when the inter-sheet time between the first sheet P1 and the second sheet P2 is equal to or longer than the raising time period toward the set temperature for the leading area Y of the second sheet P2 (S204: NO), the temperature raising timing does not need to be changed. This is because raising the temperature at the fixing nip N2 has only to be started after the rear end of the first sheet P1 passes through the fixing nip N2. In those cases, accordingly, even when the temperature at the fixing nip N2 needs to be increased, the raising start timing remains normal without changing (S207), and it is determined that the temperature raise is started at the normal timing (S206).

In the example in FIG. 11, for instance, the set temperature for the second area X2 corresponding to the rear area of the first sheet P1 is 160° C. The set temperature for the leading area of the second sheet P2 is 180° C. Thus, the set temperature for the rear area of the first sheet P1 is lower than the set temperature for the leading area Y of the second sheet P2 (S201: YES).

Therefore, the inter-sheet time between the first sheet P1 and the second sheet P2 (S202) and the time period for temperature raise toward the set temperature for the leading area Y of the second sheet P2 (S203) are calculated. FIG. 11 shows an inter-sheet distance L between the first sheet P1 and the second sheet P2 and an inter-sheet time tL corresponding to the inter-sheet distance L. Further, FIG. 11 also shows a raising time t1 required to raise the temperature to the set temperature for the leading area Y of the second sheet P2.

As shown in FIG. 11, the inter-sheet time tL is shorter than the raising time t1 (S204: YES). In the example in FIG. 11, a determination is made (S206) to advance the temperature raising timing by the raising time t1 earlier than the timing at which the leading end of the second sheet P2 enters the fixing nip N2 (S205).

When the raising timing is advanced as above, a portion near the rear end of the first sheet P1 is heated for a time t2 shown in FIG. 11 at a temperature higher than the set temperature for the second area X2. The heating temperature in the time t2 is equal to or higher than the fixing temperature, 160° C., determined as the set temperature for the second area X2. Consequently, fixing failure does not occur in even a portion near the rear end of the first sheet P1 heated at the higher temperature than the set temperature for the second area X2.

In the present embodiment, it is possible to suppress fixing failure of a toner image in the leading area Y of the second sheet P2 in the continuous printing and also suppress separation failure of the sheet P. This advantage can be obtained because, at the time when the leading end of the second sheet P2 enters the fixing nip N2, the temperature at the fixing nip N2 has reached the set temperature for the leading area Y of the second sheet P2.

The same manner as above will be applied to continuous printing on three or more sheets P. That is, continuous two sheets in this continuous printing can be each assigned the optimum timing of starting to raise the temperature by the procedure in FIG. 10.

In the present embodiment, the set temperature for the leading area Y of the sheet P is likely to be high because it is set to a higher one of the fixing temperature and the separation temperature. On the other hand, the set temperature for the rear area of the sheet P on the more rear side than the leading area Y is likely to be low because it is set to the fixing temperature required to fix the toner image.

In the continuous printing, when the set temperature for the rear area of the first sheet P1 is low and the set temperature for the leading area Y of the second sheet P2 is high, for example, it is conceivable that the inter-sheet distance may be set to be longer than usual to prevent fixing failure of the toner image and separation failure of the sheet P. However, such a long inter-sheet distance may lead to low productivity in image formation. In the present embodiment, on the other hand, even when the set temperature for the rear area of the first sheet P1 is low and the set temperature for the leading area Y of the second sheet P2 is high, the productivity in image formation is not deteriorated.

In the present embodiment, as explained in detail above, when the set temperature for the leading area Y of the second sheet P2 during continuous printing is high, the temperature at the fixing nip N2 may be raised higher than the set temperature for the rear area of the first sheet P1 during passage of the rear area of the first sheet P1 through the fixing nip N2. Accordingly, during continuous printing, it is possible to prevent fixing failure of a toner image and separation failure of a sheet P without deteriorating the productivity in image formation. This can realize the fixing device and the image forming apparatus capable of making a sheet having passed through the fixing nip appropriately separate from the fixing device without having any influence on an image to be formed.

The present embodiment is a mere example and does not give any limitations to the present invention. Thus, the present invention may be embodied in other specific forms without departing from the essential characteristics thereof. For instance, as the representative value of the toner density of each area of a sheet P, the foregoing embodiments use the value calculated from the average value of the toner density in each area. As an alternative, for example, a value calculated from a maximum value of the toner density of each area may be used as the representative value of the toner density of each area.

In the foregoing embodiments, for example, a value calculated from data of the image pattern in the image forming job is used as the toner density of each area. As an alternative, for example, a toner density of a toner image actually formed may be detected by the density sensor 20 so that such a detected value is used in the foregoing controls.

For instance, the forgoing embodiments employ both the fixing temperature table and the separation temperature table each obtained for the relationship with the grammage of a sheet P in addition to the toner density. As an alternative, the fixing temperature table or the separation temperature table may be obtained for only a relationship between the toner density of a toner image and the temperature, irrespective of the grammage of the sheet P. It is of course that using the table obtained for the relationship with the grammage of the sheet P enables accurate separation control.

For instance, the number of divided areas of each sheet P in the foregoing embodiments is a mere example and may be changed to any division number. Further, the fixing temperature and the separation temperature may be determined not only by reference to the tables as above but also by another method; for example, a calculation that multiplies a reference temperature by different coefficients according to different toner densities or the like.

Furthermore, the present invention is not limited to a color printer and is applicable to for example an image forming apparatus configured to make communication of print job via public line. The fixing device 60 is not limited to the configuration shown in FIG. 2 and may be provided in in another configuration. For instance, as an alternative to the heater 65, a fixing device of an electromagnetic induction heating type may be adopted.

Specifically, the fixing device in one aspect of the foregoing embodiments is configured to perform a fixing process for fixing a toner image on a sheet carrying unfixed toner when the sheet passes through a fixing nip of a pair of fixing members, the fixing device comprising: a heating source for heating at least one of the pair of fixing members during the fixing process; a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end; a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher; a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control to control the heating temperature of the heating source so that the leading-end set temperature becomes equal to or higher than the leading-end separation temperature.

The controller of the foregoing fixing device controls the heating temperature of the heating source so that the leading-end set temperature of the fixing nip while the leading area of the sheet is passing through the fixing nip becomes equal to or higher than the leading-end fixing temperature. This can suppress fixing failure of a toner image carried on the leading area of the sheet. When the leading-end fixing value is lower than the leading-end separation value, the separation control is performed to control the heating temperature of the heating source so that the leading-end set temperature becomes equal to or higher than the leading-end separation temperature. Toner tends to more easily separate from a fixing member as the toner receives a larger heat amount by heating. Accordingly, it is possible to suppress separation failure that the leading area of the sheet sticks to the fixing member. Of the sheet whose leading area has been appropriately separated, its rear area following the leading area can also be separated appropriately Thus, the sheet having passed through the fixing nip can be appropriately separated from the fixing device without having any influence on an image to be formed.

The fixing device in another aspect of the foregoing embodiments is configured to perform a fixing process for fixing a toner image on a sheet carrying unfixed toner when the sheet passes through a fixing nip of a pair of fixing members, the fixing device comprising: a heating source for heating at least one of the pair of fixing members during the fixing process; a press unit configured to press at least one of the pair of fixing members toward the other during the fixing process; a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end; a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher; a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a pressing force of the press unit and control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control by adjusting the pressing force of the press unit to be higher than that when the leading-end fixing value is higher than the leading-end separation value while the leading area of the sheet is passing through the fixing nip.

The controller of the foregoing fixing device controls the heating temperature of the heating source so that the leading-end set temperature of the fixing nip while the leading area of the sheet is passing through the fixing nip becomes equal to or higher than the leading-end fixing temperature. This can suppress fixing failure of a toner image carried on the leading area of the sheet. When the leading-end fixing value is lower than the leading-end separation value, the separation control is performed by adjusting the pressing force of the press unit to be higher than that when the leading-end fixing value is higher than the leading-end separation value while the leading area of the sheet is passing through the fixing nip. A sheet tends to more easily separate from the fixing member as the pressing force at the fixing nip is larger. Accordingly, it is possible to suppress separation failure that the leading area of the sheet sticks to the fixing member. Of the sheet whose leading area has been appropriately separated, its rear area following the leading area can also be separated appropriately. Thus, the sheet having passed through the fixing nip can be appropriately separated from the fixing device without having any influence on an image to be formed.

The fixing device in still another aspect of the foregoing embodiments is configured to perform a fixing process for fixing a toner image on a sheet carrying unfixed toner when the sheet passes through a fixing nip of a pair of fixing members, the fixing device comprising: a heating source for heating at least one of the pair of fixing members during the fixing process; a drive unit configured to drive the pair of fixing members to individually rotate in a normal direction during the fixing process; a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end; a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher; a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a speed of rotation of the pair of fixing members driven by the drive unit and control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control by adjusting the rotational speed of the pair of fixing members to be slower than that when the leading-end fixing value is higher than the leading-end separation value while the leading area of the sheet is passing through the fixing nip.

The controller of the foregoing fixing device controls the heating temperature of the heating source so that the leading-end set temperature of the fixing nip while the leading area of the sheet is passing through the fixing nip becomes equal to or higher than the leading-end fixing temperature. This can suppress fixing failure of a toner image carried on the leading area of the sheet. When the leading-end fixing value is lower than the leading-end separation value, the separation control is performed by adjusting the rotational speed of the pair of fixing members to be slower than that when the leading-end fixing value is higher than the leading-end separation value while the leading area of the sheet is passing through the fixing nip. The toner is heated for a longer time as the time to pass through the fixing nip is longer. Toner tends to more easily separate from the fixing members as the toner receives a larger heat amount by heating. Accordingly, it is possible to suppress separation failure that the leading area of the sheet sticks to the fixing member. Of the sheet whose leading area has been appropriately separated, its rear area following the leading area can also be separated appropriately. Thus, the sheet having passed through the fixing nip can be appropriately separated from the fixing device without having any influence on an image to be formed.

In the fixing device described above, the leading-end toner value output part may be configured to obtain a leading-end separation toner value indicating an adhesion amount of toner of a toner image carried on each of divided areas defined by dividing the leading area of the sheet, and output, as the leading-end toner value, a representative value representing the leading-end separation toner value of each of the separation areas.

In the fixing device described above, preferably, the leading-end toner value output part is configured to output the leading-end toner value for each of a plurality of divided areas defined by dividing the leading area of the sheet in a conveying direction, the leading-end fixing value output part is configured to output the leading-end fixing value for each of the divided areas, the leading-end separation value output part is configured to output the leading-end separation value for each of the divided areas, and the controller is configured to perform the separation control on each of the divided areas. This is because the leading area of the sheet can be more reliably separated from the fixing member.

In the fixing device described above, preferably, the leading-end fixing value output part is configured to output a lower value as the leading-end fixing value for a lower grammage of the sheet. This is because the temperature required to fix a toner image on a sheet is lower for a lower grammage of the sheet. That is, power consumption associated with heating can be reduced.

In the fixing device described above, preferably, the leading-end separation value output part is configured to output a lower value as the leading-end separation value for a higher grammage of the sheet. This is because the sheet is higher in rigidity as the grammage is higher, so that a separation or peeling force from the fixing member is strong. That is, power consumption associated with heating can be reduced.

The fixing device described above preferably further comprises: a rear-side toner value output part configured to output a rear-side toner value indicating an adhesion amount of toner of a toner image carried on a rear area determined in advance on the rear side than the leading area of the sheet; and a rear-side fixing value output part configured to set a rear-side fixing value indicating a rear-side fixing temperature required to fix the toner image carried on the rear area of the sheet onto the sheet according to the rear-side toner value so that the rear-side fixing value is higher as the rear-side toner value is higher, and wherein the controller controls a heating temperature of the heating source so that a rear-side set temperature at the fixing nip while the rear area of the sheet is passing through the fixing nip becomes equal to or higher than the rear-side fixing temperature. This is because the fixing failure of the toner image on the rear area of the sheet can also be suppressed.

In the fixing device described above, preferably, when a first sheet and a second sheet following the first sheet are to be continuously delivered to pass through the fixing nip, when the leading-end set temperature for the second sheet is higher than the rear-side set temperature for the first sheet, the controller raises a temperature at the fixing nip to a higher temperature than the rear-side set temperature for the first sheet even while the rear area of the first sheet is passing through the fixing nip. Since the inter-sheet distance between the first sheet and the second sheet is set longer, for example, the productivity is not deteriorated.

In the fixing device described above, preferably, the leading area of the sheet has a length in a conveying direction in a range from a length of the fixing nip in the sheet conveying direction to a quarter of the length of the sheet in the conveying direction. Since the length of the leading area of the sheet is set longer than the length of the fixing nip, the leading end of the sheet can be reliably separated from the fixing member. If the length of the leading area is set too long, power consumption in the separation control is apt to be increased by just that much.

The image forming apparatus in the foregoing embodiment comprises: a conveying unit for conveying a sheet; an image forming unit for transferring a toner image onto the sheet; and a fixing device according to claim 1, provided downstream of the image forming unit in the conveying direction of the sheet.

1 Image forming apparatus
60 Fixing device
61 Pressure roller
62 Fixing roller
63 Heating roller
64 Fixing belt
65 Heater
66 Drive part
67 Press part
80 CPU
81 Fixing temperature output part
82 Separation temperature output part

91 Fixing temperature storage part
92 Separation temperature storage part
N2 Fixing nip
P Sheet
Y Leading area

What is claimed is:

1. A fixing device configured to perform a fixing process for fixing a toner image on a sheet carrying unfixed toner when the sheet passes through a fixing nip of a pair of fixing members, the fixing device comprising:

a heating source for heating at least one of the pair of fixing members during the fixing process;

a leading-end toner value output part configured to output a leading-end toner value indicating a toner adhesion amount in the toner image carried on a leading area corresponding to an area including a leading end of the sheet in a conveying direction and extending by a predetermined length on a rear side from the leading end;

a leading-end fixing value output part configured to output a leading-end fixing value indicating a leading-end fixing temperature necessary to fix the toner image carried on the leading area of the sheet to the sheet, according to the leading-end toner value, and configured to set a higher value to the leading-end fixing value as the leading-end toner value is higher;

a leading-end separation value output part configured to output a leading-end separation value indicating a leading-end separation temperature necessary to allow the leading area of the sheet to pass through the fixing nip and separate from the pair of fixing members, according to the leading-end toner value, and configured to set a higher value to the leading-end separation value as the leading-end toner value is higher; and a controller configured to control a heating temperature of the heating source so that a leading-end set temperature at the fixing nip while the leading area of the sheet is passing through the fixing nip becomes equal to or higher than the leading-end fixing temperature, wherein when the leading-end fixing value is lower than the leading-end separation value, the controller performs separation control to control the heating temperature of the heating source so that the leading-end set temperature becomes equal to or higher than the leading-end separation temperature.

2. The fixing device according to claim 1, wherein the leading-end toner value output part is configured to obtain a leading-end separation toner value indicating an adhesion amount of toner of a toner image carried on each of divided areas defined by dividing the leading area of the sheet, and output, as the leading-end toner value, a representative value representing the leading-end separation toner value of each of the separation areas.

3. The fixing device according to claim 1, wherein the leading-end toner value output part is configured to output the leading-end toner value for each of a plurality of divided areas defined by dividing the leading area of the sheet in a conveying direction, the leading-end fixing value output part is configured to output the leading-end fixing value for each of the divided areas, the leading-end separation value output part is configured to output the leading-end separation value for each of the divided areas, and the controller is configured to perform the separation control on each of the divided areas.

4. The fixing device according to claim 1, wherein the leading-end fixing value output part is configured to output a lower value as the leading-end fixing value for a lower grammage of the sheet.

5. The fixing device according to claim 1, wherein the leading-end separation value output part is configured to output a lower value as the leading-end separation value for a higher gram mage of the sheet.

6. The fixing device according to claim 1, further comprising:

a rear-side toner value output part configured to output a rear-side toner value indicating an adhesion amount of toner of a toner image carried on a rear area determined in advance on the rear side than the leading area of the sheet; and a rear-side fixing value output part configured to set a rear-side fixing value indicating a rear-side fixing temperature required to fix the toner image carried on the rear area of the sheet onto the sheet according to the rear-side toner value so that the rear-side fixing value is higher as the rear-side toner value is higher, and wherein the controller controls a heating temperature of the heating source so that a rear-side set temperature at the fixing nip while the rear area of the sheet is passing through the fixing nip becomes equal to or higher than the rear-side fixing temperature.

7. The fixing device according to claim 6, wherein when a first sheet and a second sheet following the first sheet are to be continuously delivered to pass through the fixing nip, when the leading-end set temperature for the second sheet is higher than the rear-side set temperature for the first sheet, the controller raises a temperature at the fixing nip to a higher temperature than the rear-side set temperature for the first sheet even while the rear area of the first sheet is passing through the fixing nip.

8. The fixing device according to claim 1, wherein the leading area of the sheet has a length in a conveying direction in a range from a length of the fixing nip in the sheet conveying direction to a quarter of the length of the sheet in the conveying direction.

9. An image forming apparatus comprising:

a conveying unit for conveying a sheet;

an image forming unit for transferring a toner image onto the sheet; and the fixing device according to claim 1, provided downstream of the image forming unit in the conveying direction of the sheet.

* * * * *